US005845980A

United States Patent [19]

Fricano et al.

[11] Patent Number: 5,845,980

[45] Date of Patent: Dec. 8, 1998

[54] OVERHEAD STORAGE CABINET

[75] Inventors: Nicholas J. Fricano, Grand Haven; Scott A. Lang, Hudsonville; Richard G. Haworth, Holland, all of Mich.

[73] Assignee: Haworth, Inc., Holland, Mich.

[21] Appl. No.: 744,265

[22] Filed: Nov. 6, 1996

[51] Int. Cl.[6] ..... A47F 5/08

[52] U.S. Cl. ..... 312/327; 312/319.4; 312/247; 49/40

[58] Field of Search ..... 312/327, 328, 312/326, 319.4, 245, 246, 247; 16/81; 220/262, 263, 264, 335, 337, 338, 343; 49/40, 41, 381

[56] References Cited

U.S. PATENT DOCUMENTS

| | | | |
|---|---|---|---|
| 287,068 | 10/1883 | Tyler . | |
| 436,481 | 9/1890 | James . | |
| 463,150 | 11/1891 | Graves | 312/319.4 X |
| 658,310 | 9/1900 | Babb . | |
| 1,800,519 | 4/1931 | Fredberg | 312/327 |
| 1,964,578 | 6/1934 | Hunter . | |
| 2,089,709 | 8/1937 | Rabkin | 312/328 |
| 2,301,856 | 11/1942 | Conwell . | |
| 2,551,305 | 5/1951 | Tompkins . | |
| 2,617,702 | 11/1952 | Manning et al. | 312/327 |
| 3,128,508 | 4/1964 | Burnham | 49/41 |
| 4,167,298 | 9/1979 | Plattner . | |
| 4,616,891 | 10/1986 | Jantzen | 312/328 |
| 4,798,425 | 1/1989 | Armstrong et al. . | |
| 4,856,854 | 8/1989 | Nishiyama et al. | 312/328 X |
| 5,172,969 | 12/1992 | Reuter et al. . | |
| 5,257,638 | 11/1993 | Alvemarker . | |
| 5,339,852 | 8/1994 | Bull | 49/40 X |
| 5,409,308 | 4/1995 | Reuter et al. . | |

FOREIGN PATENT DOCUMENTS

| | | | |
|---|---|---|---|
| 2 091 715 | 12/1971 | France . | |
| 302737 | 12/1936 | Italy | 312/319.4 |
| 436605 | 6/1948 | Italy | 49/40 |

OTHER PUBLICATIONS

The Complete Häfele brochure (4 pages).

Speciale brochure, Oct. 1994, Haworth Europe, (3 pages).

Sitag USA Inc., Sitag International brochure, Oct. 1996 (3 pages).

Sasea spa "Oasy" brochure, Oct. 1996 (3 pages).

TNT "The office that evolves" brochure, Oct. 1996, Steelcase Strafor, (3 pages).

Drawings of Castelli overhead unit dated Nov. 1994, Sheets 1–5.

*Primary Examiner*—Peter M. Cuomo
*Assistant Examiner*—Hanh V. Tran
*Attorney, Agent, or Firm*—Flynn, Thiel, Boutell & Tanis, P.C.

[57] ABSTRACT

An overhead storage cabinet having a housing defined by top and bottom wall rigidly joined by end walls to define an interior storage compartment therein. A door assembly is vertically swingably mounted on the housing and includes a door panel which vertically closes a front access opening of the housing when in an open position, and which swings upwardly into an open position wherein the door panel is stored generally above the top wall. The door assembly includes end panels which exteriorly overlap and are hingedly couple to the end walls. The end panels mount one or more counterweight elements adjacent the ends thereof to counterbalance the door panel weight. The number or position of counterweight elements is selected in accordance with the longitudinal length of the door panel. The end panel also has an edge profile provided with a grip part which moves between positions disposed adjacent the lower rear and lower front corners of the housing as the door is respectively swingably moved between closed and open positions to facilitate access thereto and convenient manual swinging of the door, particularly in the closing direction. The door panel and top wall of the housing also have an interlock extending longitudinally therealong and engaged when the door is closed to prevent outward bowing of the door relative to the housing.

30 Claims, 17 Drawing Sheets

62
67
72
64
65
106
105
31
71
91
92
106
97
68
94
72
88
98
89
69
73
66

OVERHEAD STORAGE CABINET

FIELD OF THE INVENTION

This invention relates to a storage cabinet of the type used in offices and the like and, more particularly, to an improved storage cabinet intended for mounting in an overhead position relative to a worksurface or the like to provide improved ease of operation with respect to opening and closing of the cabinet.

BACKGROUND OF THE INVENTION

Overhead cabinets are conventionally and widely used in office environments and the like for storage of papers, books and miscellaneous. Such cabinets are conventionally mounted in an overhead position with respect to a worksurface, such as above a table or desk. In many such situations the cabinet is mounted on a side surface of a wall, such as a portable space-divider panel, and is positioned in upwardly spaced relation from a worksurface so as to be reasonably close and hence accessible, but yet not interfere with use of the worksurface. Cabinets of this type have often employed an openable front door which moves with a combined hinging and sliding movement whereby the door is initially hinged upwardly into an open position, and then horizontally slidably moved rearwardly into a storage position wherein the door is disposed closely adjacent and positioned either above or below the top wall of the cabinet. While cabinets of this type have been extensively utilized for many years, such cabinets nevertheless have possessed recognized disadvantages with respect to ease of access. More specifically, while the door often times can be moved into an open position by a person seated adjacent a front of the worksurface, nevertheless closing of the door normally requires that the person stand and grip the front edge of the door and then pull the door outwardly while permitting it to swing downwardly into the closed position. Performing the door opening and closing function has thus been undesirable in that such cannot be conveniently accomplished in a seated position. Further, the complex or multiple phases of the door movement, and the forces associated therewith, have increased the difficulty of opening and closing the cabinet door.

In an attempt to improve on cabinets of this general type, some cabinets have been provided with a door which is solely swingable between open and closed positions. In these known cabinets, the door has been provided with end panel arms which provide a horizontal swinging axis so that the door solely swings between a closed position and a generally overhead open position. The cabinets of this latter type, however, have themselves possessed features which have been less than desirable. For example, in some of the cabinets the door has been solely manually swingable in both the opening and closing direction which, coupled with the unbalanced weight of the door, has made the opening and closing movement less than desirable. Other cabinets of this type, in an attempt to improve on this situation, have provided gas springs to assist in opening the door and thus assist in overcoming the door weight during the opening movement, but contrarily the gas springs causes the force required for closing the door to be increased and thus makes the closing movement less advantageous than is desired.

Examples of known overhead storage cabinets are illustrated by the following U.S. Pat. Nos. 1,115,345, 2,301,856, 2,551,305, 2,590,028, 4,167,298, 4,371,223, 5,050,944, 5,172,969, and 5,409,308.

It is thus an object of this invention to provide an improved overhead storage cabinet, particularly for use in an office environment, which is believed to significantly improve upon prior cabinets of this general type, and particularly is believed to overcome many of the disadvantageous mentioned above.

More specifically, it is an object of this invention to provide an improved overhead storage cabinet employing a door which is supported solely for swinging movement between a closed position and an overhead storage position, which door is designed so as to be conveniently accessible by an occupant seated adjacent an underlying worksurface or the like, whereby the door can be readily manually engaged and readily and comfortably swingably moved in both opening and closing directions, while at the same time enabling the operator to remain in a seated position.

It is also an object of the invention to provide an improved overhead storage cabinet, as aforesaid, which enables the door to be readily swingably moved between open and closed positions, in both the opening direction and the closing direction, while enabling the swinging of the door to be easily manually controlled without requiring application of significant force or effort.

A further object of the invention is to provide an improved overhead storage cabinet, as aforesaid, which employs a counterweight associated with the swinging door, which counterweight can be readily adjusted so as to have a counterbalance moment generally in conformance with the longitudinal length of the door so as to permit the counterweight to be readily selected in accordance with the door length to thus provide for proper counterweighing of the door to create a better balance of the weight and hence moment imposed on the door during opening and closing movements thereof.

Still a further object of the invention is to provide an improved overhead storage cabinet, as aforesaid, which employs an interfitting or interlocking relationship between the upper edge of the door and the top wall of the cabinet, along the longitudinal length thereof, to prevent bowing or separation of the door from the cabinet housing, thereby tending to prevent unintended or unauthorized entry into the cabinet.

Another object of the invention is to provide an improved overhead storage cabinet, as aforesaid, which is of reasonably lightweight but durable construction, which can be manufactured with reasonable efficiency and economy, which can be easily and efficiently mounted on vertical walls or upright space-dividing wall panels, which can be mounted on such walls or wall panels without regard to the particular size of the wall panels on which the cabinet is being mounted, namely permitting the cabinet to be mounted on wall panels in a off-modular relationship, and which provides a desirable appearance.

Other objects and purposes of the invention will be apparent to persons familiar with structures of this general type upon reading the following specification and inspecting the accompanying drawings.

Figure 1:
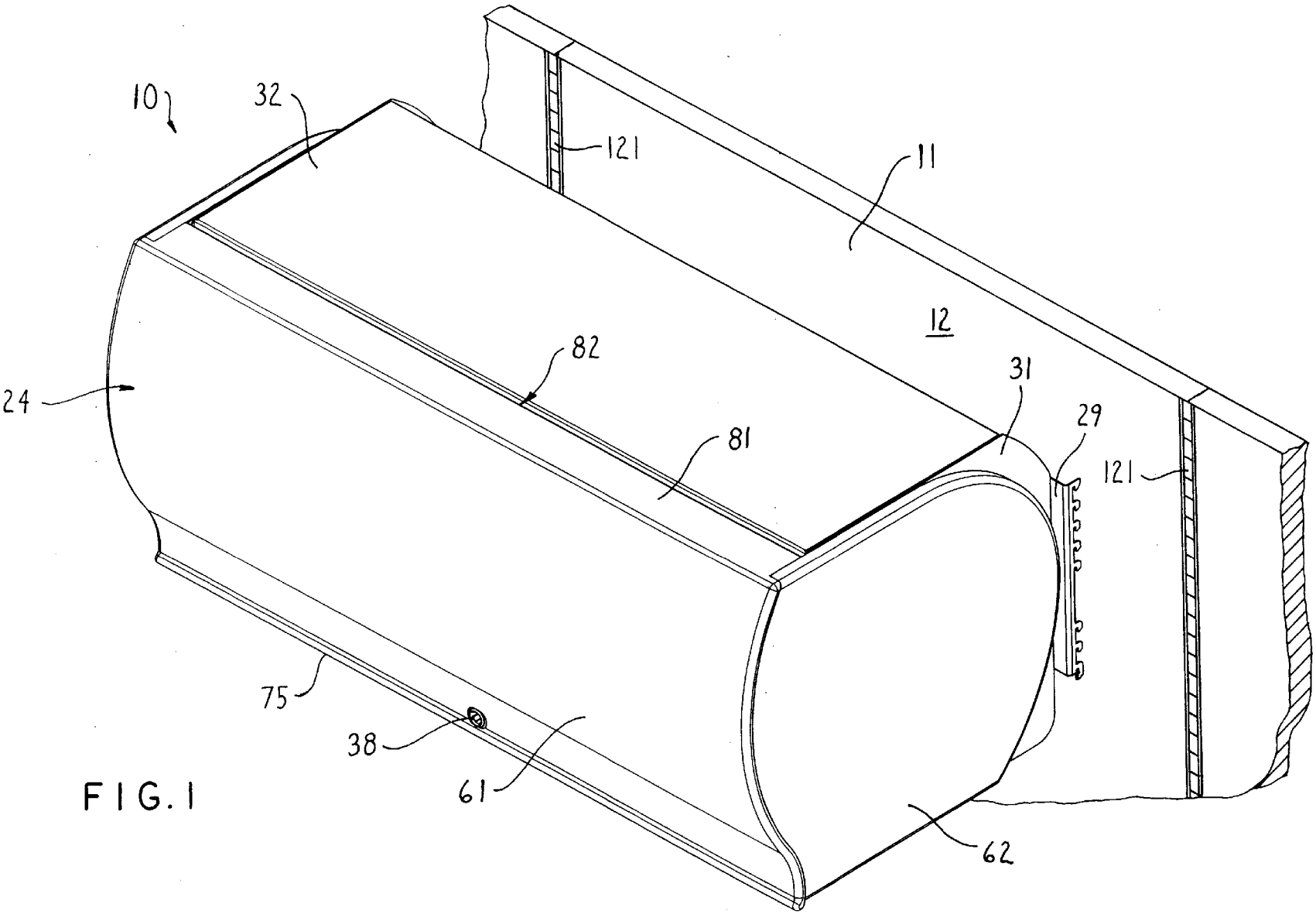
FIG. 1 is a front perspective view of an overhead storage cabinet according to the present invention, the cabinet being illustrated in a closed position and in adjacent relationship to an upright wall.

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also be used to refer to the swinging movement of the cabinet door toward the open and closed positions, respectively. The words "inwardly" and "outwardly" will refer to directions toward and away from, respectively, the geometric center of the cabinet and designated parts thereof. Said terminology will include the words specifically mentioned, derivatives thereof, and words of similar import.

DETAILED DESCRIPTION

Figure 17:
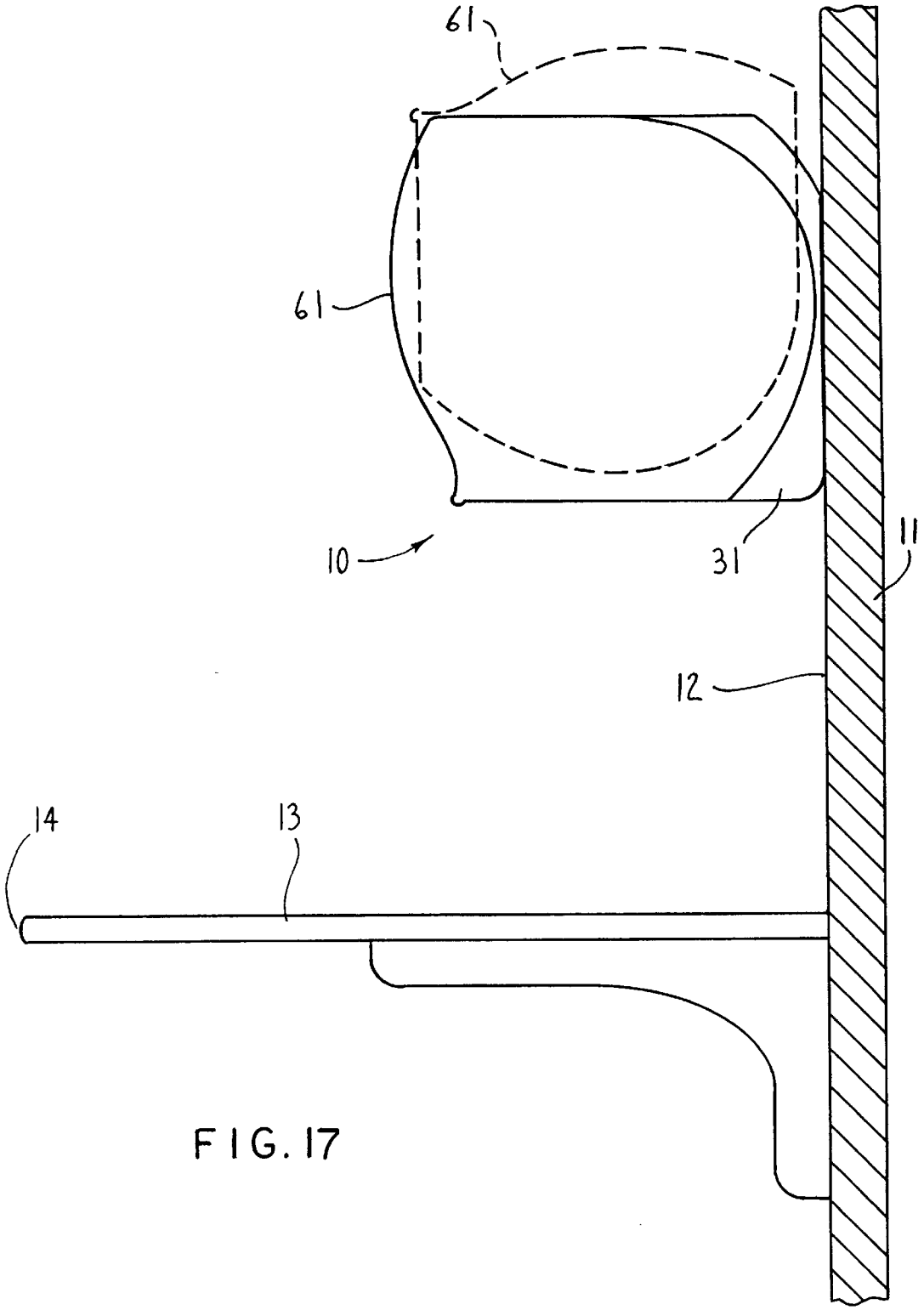
FIG. 17 is a diagrammatic elevational view illustrating the overall arrangement of the overhead storage cabinet mounted on an upright wall and disposed in overhead relationship with respect to a worksurface which is mounted on or adjacent the upright wall.

Reviewing to the drawings and specifically FIGS. 1 and 17, there is illustrated a storage cabinet 10 according to the present invention. This cabinet can be mounted on an upright wall 11, such as adjacent a vertical surface 12 thereof so as to be disposed in overhead, that is upwardly spaced relationship, relative to a worksurface 13 such as a table or desk as disposed adjacent the wall. A person will normally be positioned or seated adjacent a front edge 14 of the worksurface 13, and the cabinet 10 is disposed so as to be conveniently accessible to a person seated adjacent the front edge 14.

Figure 3:
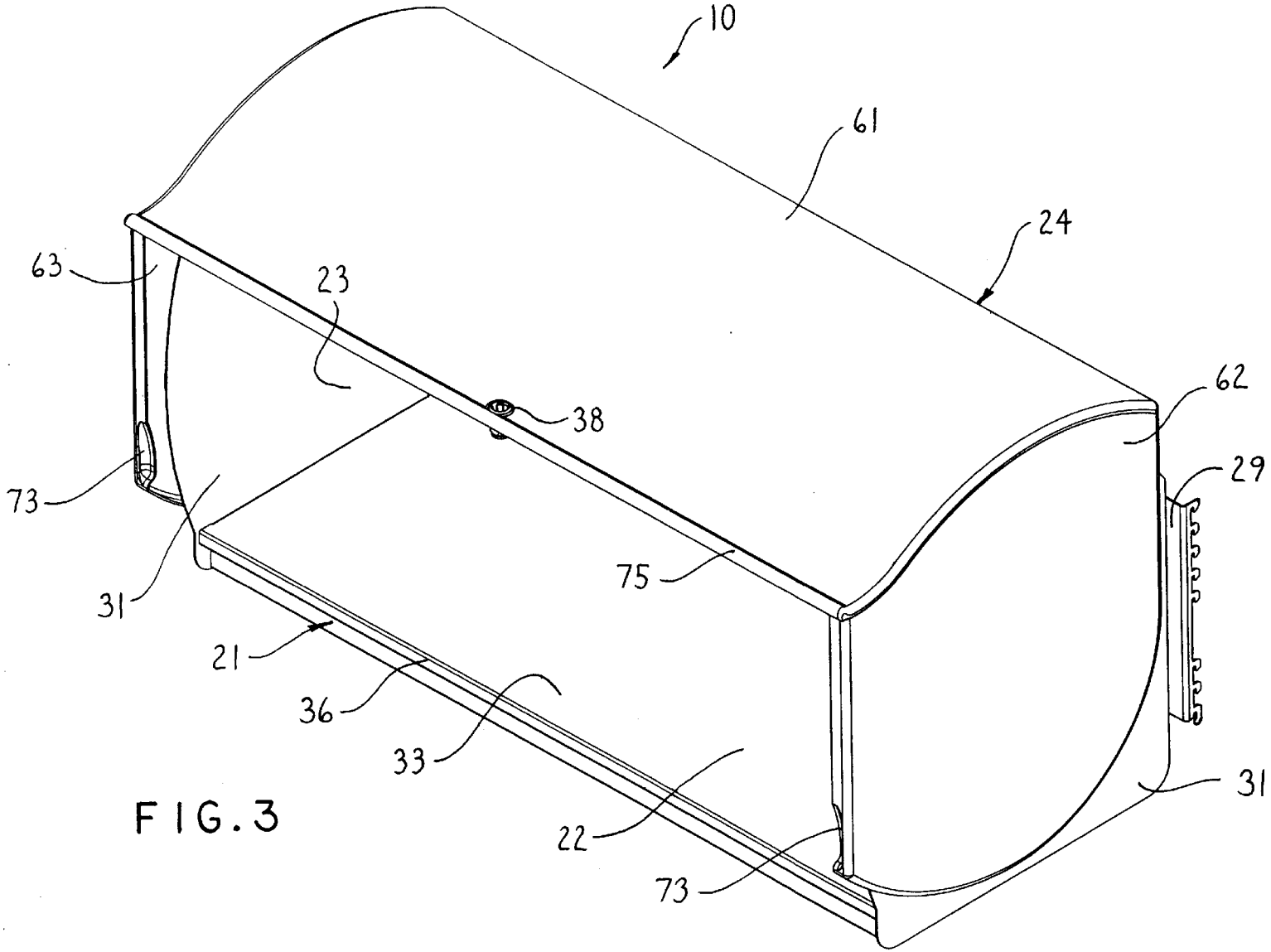
FIG. 3 is a front perspective view similar to FIG. 1 except that the cabinet is shown with the door in an open overhead position.
Figure 4:
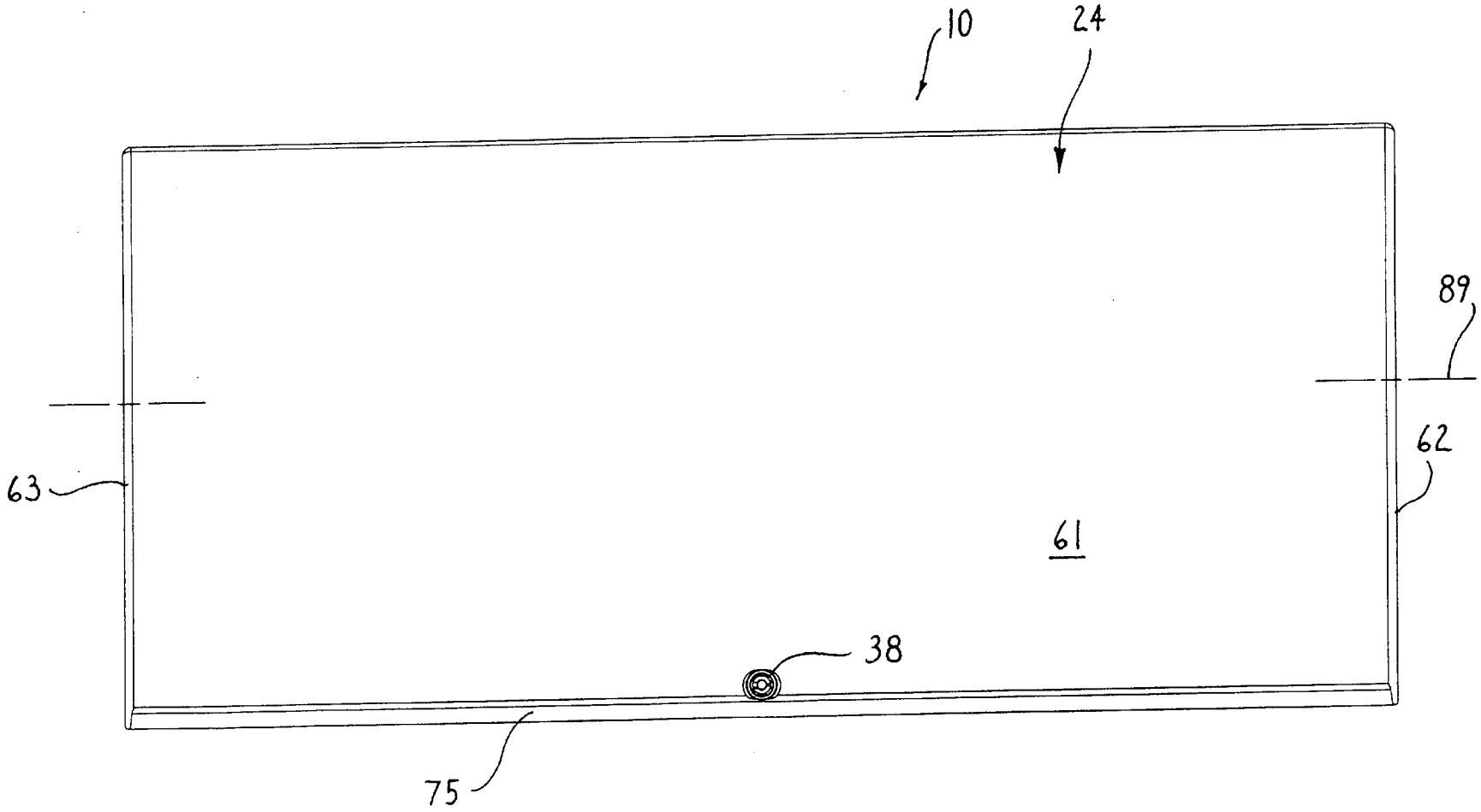
FIG. 4 is a front view of the cabinet as shown in FIG. 1.
Figure 5:
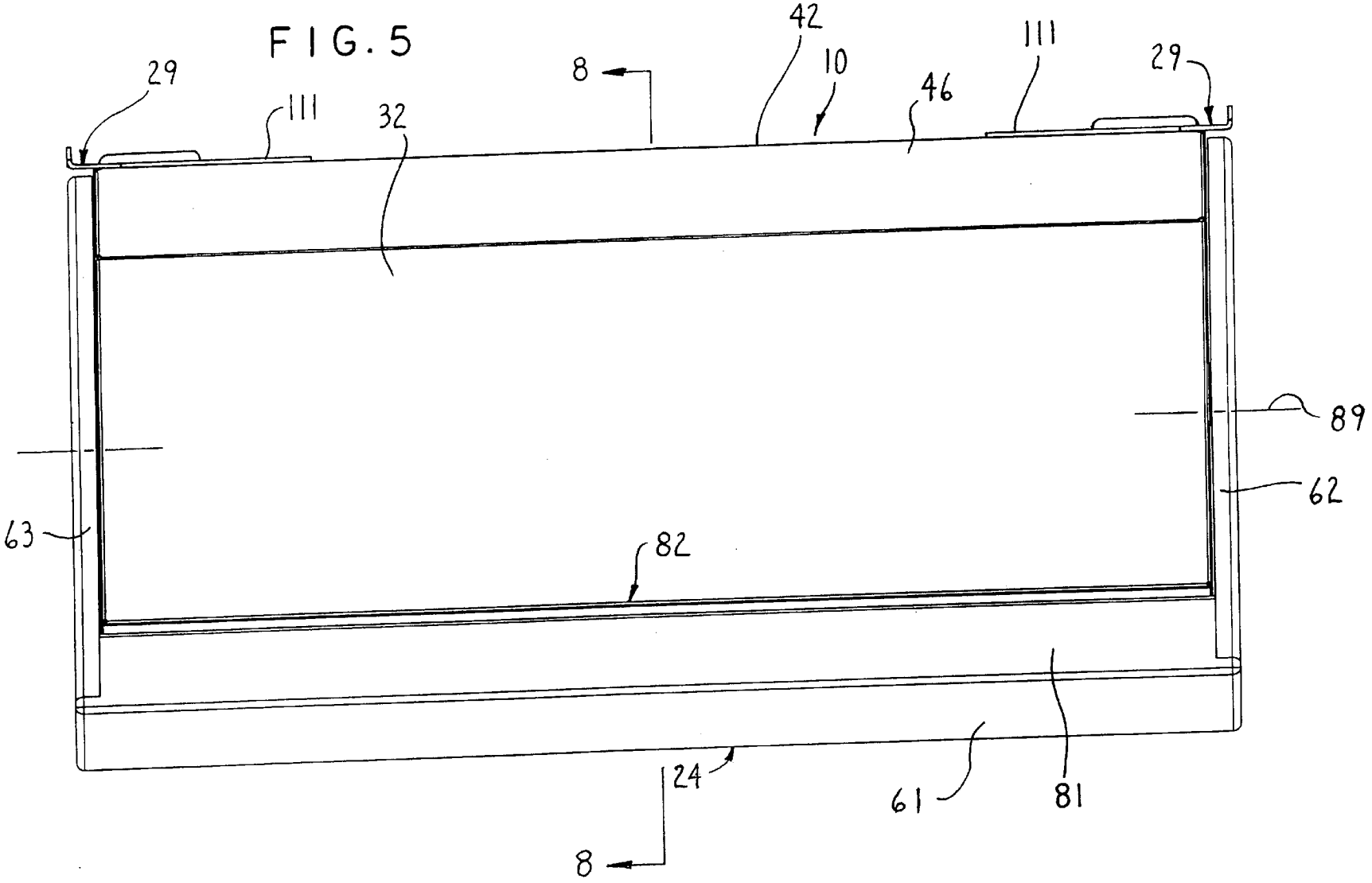
FIG. 5 is a top view of the cabinet as shown in FIG. 4.
Figure 6:
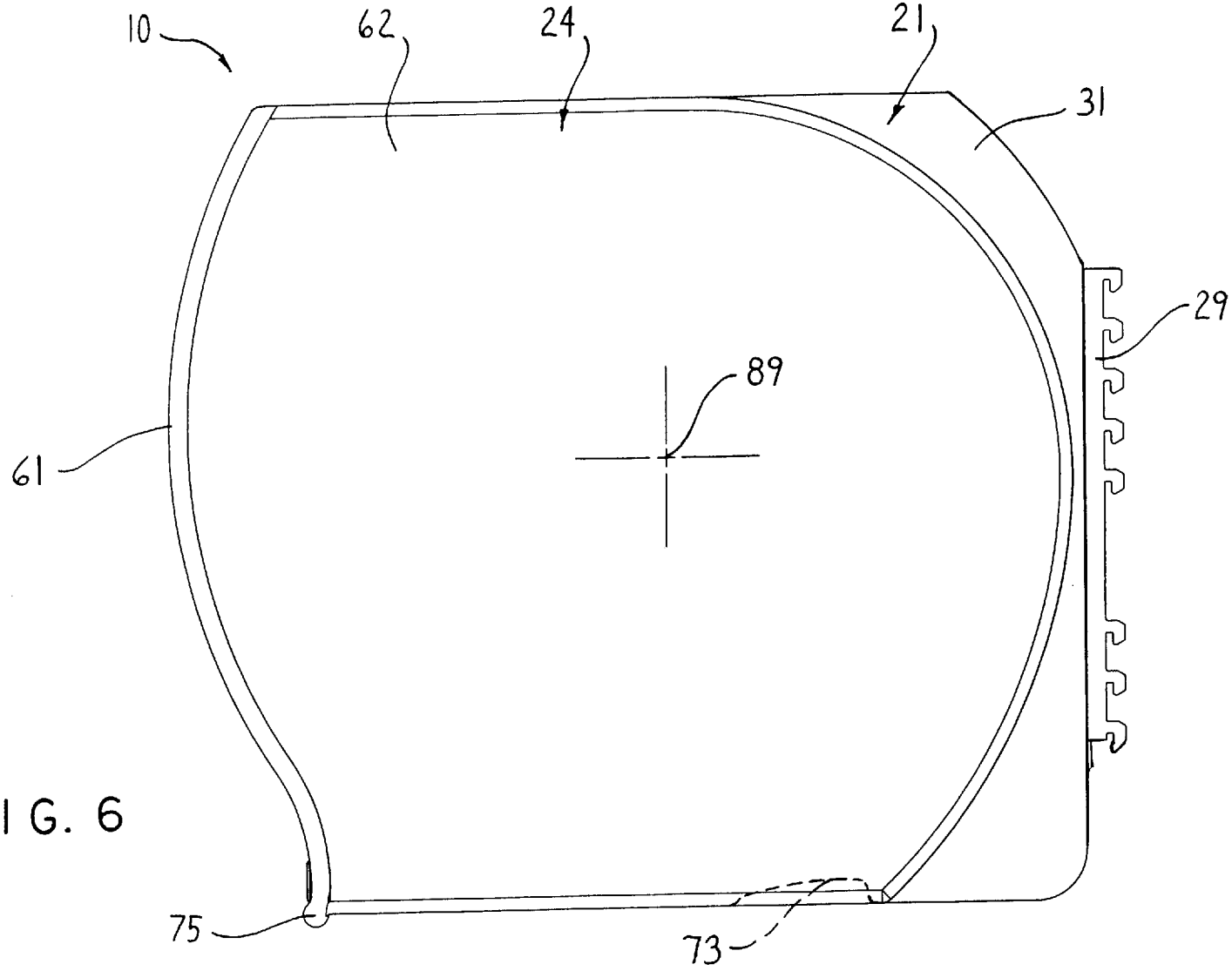
FIG. 6 is a right end elevational view of the cabinet shown in FIG. 1, and showing the door in a closed position.

The storage cabinet 10 of this invention includes a housing or body 21 which, as illustrated by FIGS. 1 and 3, is of a generally boxlike configuration having an opening 22 on the front side thereof which provides access to the interior storage compartment 23. A door assembly 24 is swingably mounted on the housing 21 for movement between the closed position illustrated in FIG. 1 wherein it closes off the front opening and an overhead storage position illustrated in FIG. 3 wherein the cabinet is in an open or accessible position. The cabinet is intended for cooperation with suitable mounting brackets 29, one example of which is illustrated in FIG. 1, for permitting suitable support of the cabinet, such as to an upright wall 11. The structure of various version of mounting brackets for securing the cabinet will be briefly explained hereinafter.

Figure 1A:
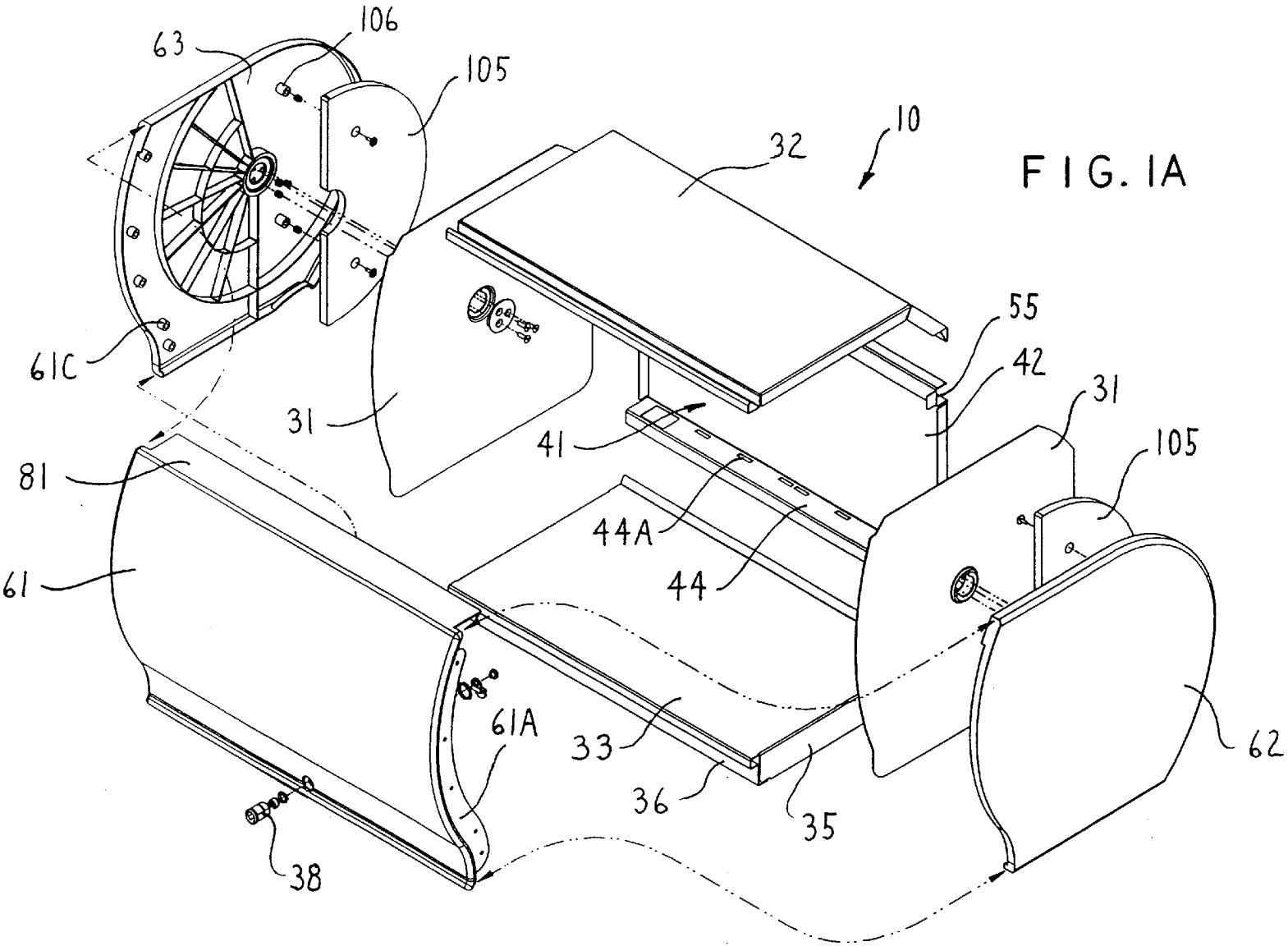
FIG. 1A is an exploded perspective of the cabinet shown in FIG. 1.
Figures 8, 8A, 8B, 8C:
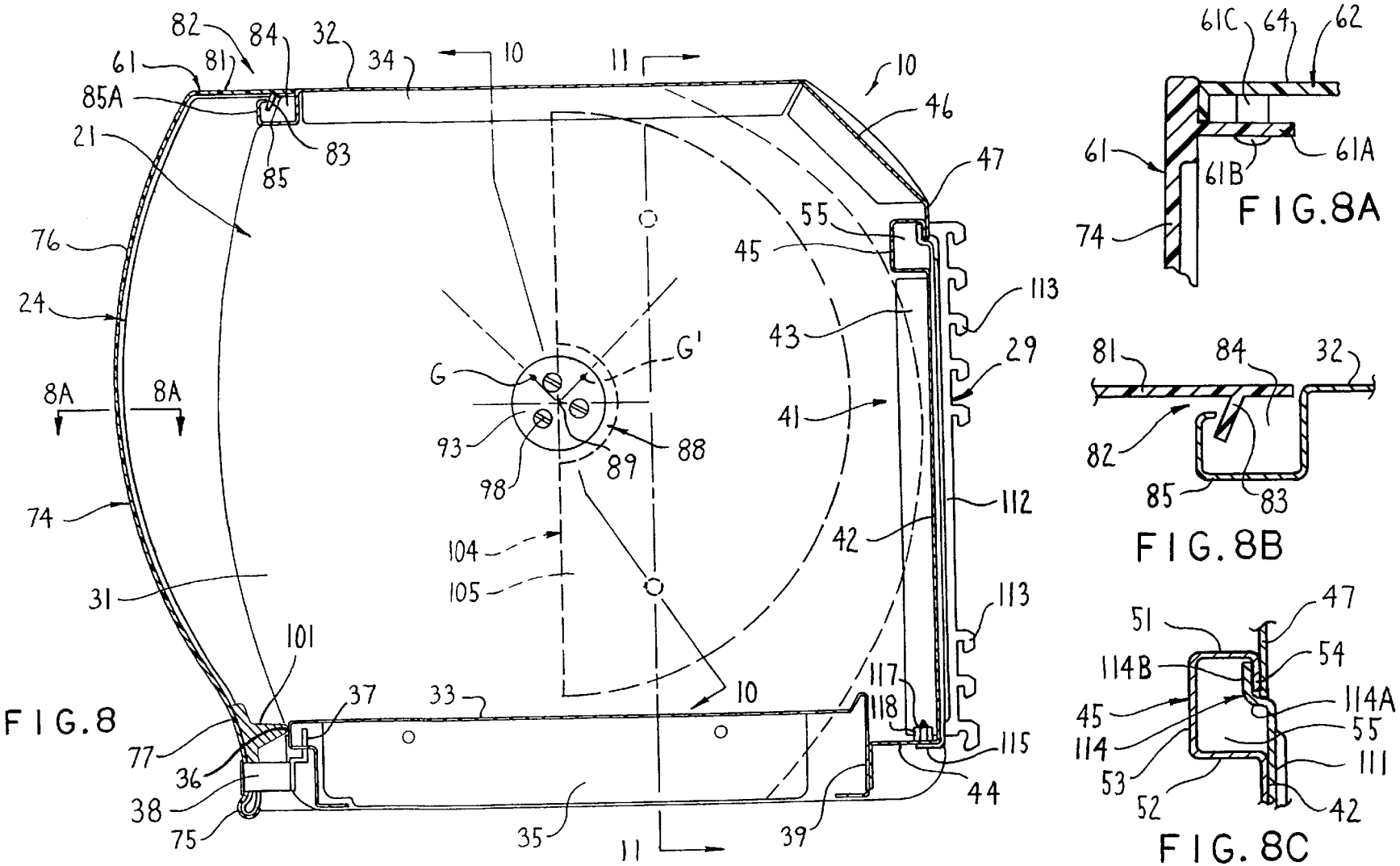
FIG. 8 is an enlarged cross sectional view of the cabinet as taken generally along line 8—8 in FIG. 5.
FIG. 8A is an enlarged fragmentary sectional view taken generally along line 8A—8A in FIG. 8.
FIG. 8B is an enlarged fragmentary sectional view showing the anti-separation interlock between the upper edge of the door panel and the front edge of the cabinet top wall.
FIG. 8C is an enlarged fragmentary sectional view showing the mounting rail along the upper back of the cabinet.
Figure 11:
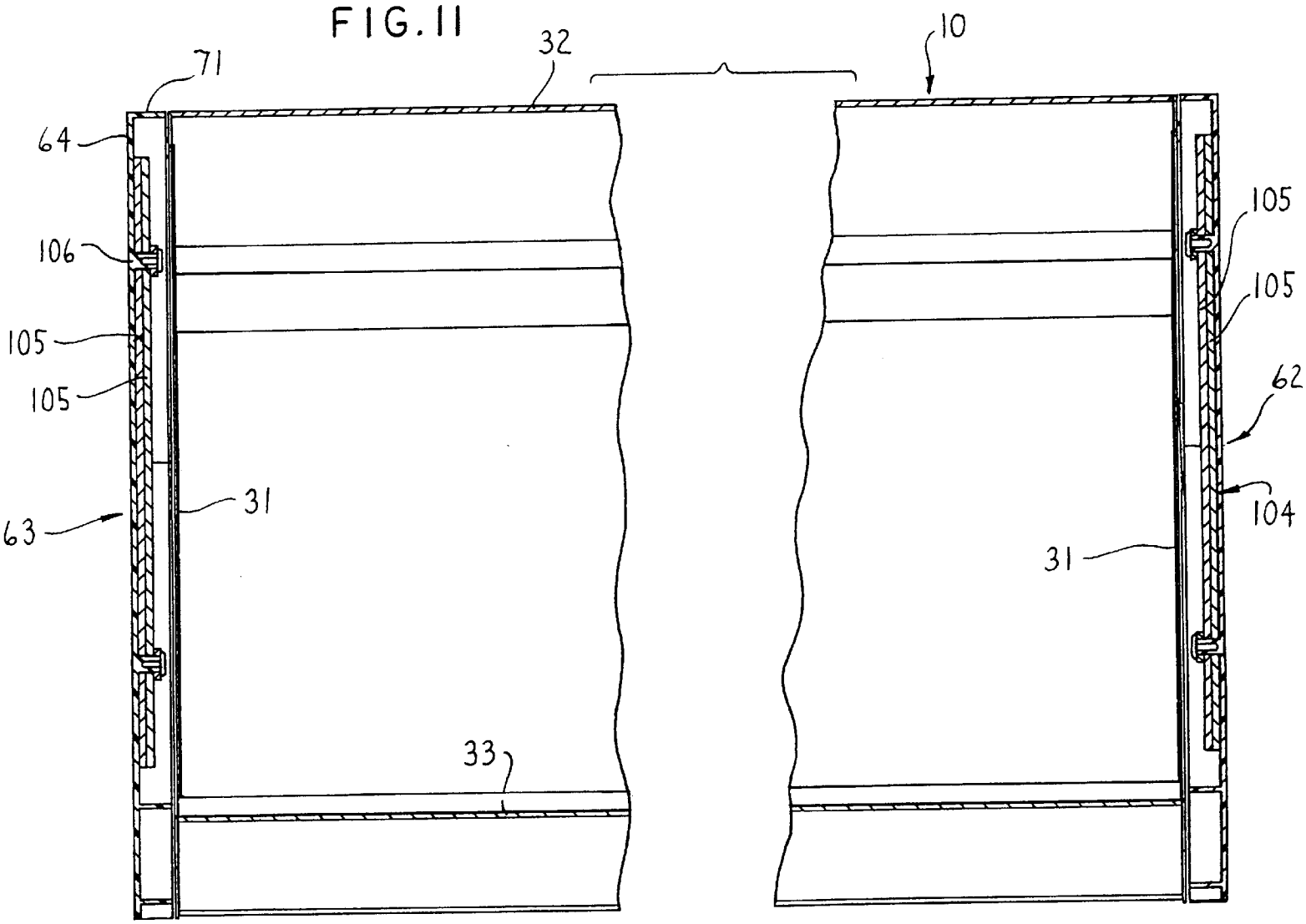
FIG. 11 is an enlarged fragmentary sectional view taken generally along line 11—11 in FIG. 8.

Considering first the structure of the housing or body 21, and referring specifically to FIGS. 1A, 8 and 11, the housing includes a pair of generally parallel but longitudinally spaced apart end walls 31 which are disposed in generally vertical planes and which are rigidly joined together by generally parallel and horizontally elongated top and bottom walls 32 and 33, respectively. The top wall 32 has downwardly-turned end flanges 34 which overlap the inner upper part of the end walls 31 for fixed securement thereto, such as by welding. The top wall 32, at its rear end, has a rear wall part 46 which is angled downwardly and which terminates in a downwardly cantilevered edge flange 47.

The bottom wall 33 has similar downwardly-turned end flanges 35 which overlap the inner lower portions of the end walls 31 and are fixedly secured thereto. This thus results in the end walls 31 as well as the top and bottom walls 32 and 33 being rigidly joined to define a generally tubular configuration when viewed horizontally from the front side thereof, with this tubular configuration defining the front opening 22 which accesses the interior storage compartment 23 of the housing. The bottom wall 33 also has a generally Z-shaped front flange 36 which is fixed to and projects downwardly from the front edge of the bottom wall. This front flange 36, in the horizontal intermediate part thereof, has an opening for accommodating a pivotal latch plate 37 which is connected to the inner end of a cylindrical rotatable plug associated with a conventional key-activated lock 38, the latter being mounted on the door assembly adjacent the lower end thereof. The construction of the lock 38 and its latching relationship is generally conventional, and further description thereof is believed unnecessary.

The bottom wall 33 also has a rear flange 39 which is fixed to and projects downwardly from the rear edge of the bottom wall. The bottom wall 33, together with the downwardly projecting front and rear flanges 36 and 39, as well as the downwardly projecting end flanges 35, define a generally downwardly-opening boxlike configuration. This provides the bottom wall with significant strength and rigidity, and this in turn also provides significant strength and rigidity to the overall cabinet housing.

The cabinet housing 21 also includes a rear wall 41 which joins to and generally closes off the rear of the horizontal tubular structure defined by the walls 31, 32 and 33. The rear wall 41 has a main vertical wall part 42 which extends downwardly through a significant vertical extent from adjacent the top wall of the housing, and this vertical wall part 42 has inwardly-turned edge flanges 43 which overlap and are fixedly secured to the adjacent end walls 31 adjacent the rear edges thereof. The rear wall part 42 at its lower end is provided with a generally inwardly projecting L-shaped bottom flange 44 which abuts and is fixedly secured to the rear flange 39 associated with the bottom wall 33. This bottom flange 44, in the horizontal wall part thereof, has a plurality of elongate slotlike openings 44A extending vertically therethrough in spaced relation longitudinally along the flange.

The rear wall 41 also has a channel-like rail member fixedly associated therewith and extending longitudinally (i.e. horizontally) along the length thereof. This rail member 45 is fixed to the upper edge of the wall part 42 and projects frontwardly therefrom. The rail member 45 (FIG. 8C) includes respective upper and lower walls 51 and 52 joined by a vertical wall 53 which is spaced frontwardly from the rear wall part 42. The rear edge of lower wall 52 joins to the upper edge of wall part 42. The rear edge of upper wall 51 joins to a downwardly cantilevered flange 54. This flange 54 overlaps and is fixedly secured to the edge flange 47, as by welding. The rail 45 thus defines a L-shaped guide channel 55 which opens rearwardly and extends longitudinally along the rear side of the cabinet housing. This rear guide channel 55 cooperates with mounting brackets for permitting securement of the cabinet to an upright wall, as explained hereinafter.

Considering now the door assembly 24, it is of a generally U- or channel-shaped configuration and includes a longitudinally elongate door panel 61 which at opposite ends is fixedly joined to rearwardly projecting right and left end panels 62 and 63, respectively. The end panels 62 and 63 are cantilevered rearwardly away from the door panel 61 in generally parallel relationship. These end panels 62 and 63 are are positioned so as to be disposed closely adjacent and in overlapping relationship to the exterior surface of a respective one of the cabinet housing end walls 31, and the end panels 62 and 63 are enlarged generally vertically so as to cover substantially the entire surface of the respective housing end walls 31 as illustrated in FIG. 11.

The right and left end panels 62 and 63 are substantially identical except for being mirror images of one another, and it will be appreciated that the following description relates to both end panels and the pivotal connection therewith to the respectively adjacent end wall 31.

Figure 9:
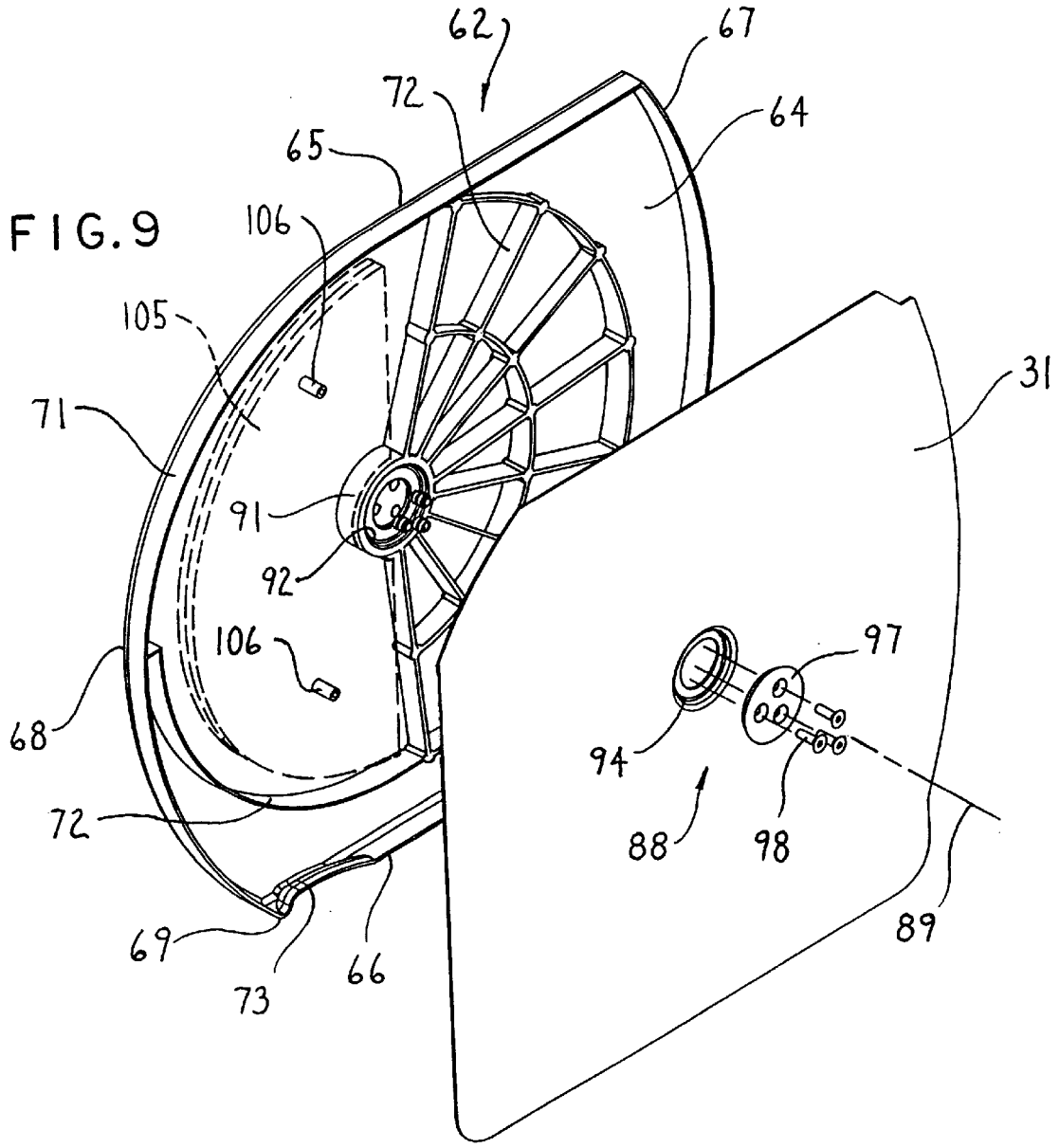
FIG. 9 is an exploded perspective view illustrating the right door end panel and its relationship to the adjacent end wall of the housing.

As illustrated by FIG. 9, the end panel 62, 63 includes a generally vertical outer wall 64 which terminates in an outer periphery defined by generally upper and lower edges 65 and 66 which extend generally horizontally in parallel relation, with these edges being joined by a front edge 67 of complex curvature, which curvature corresponds to the curvature of the door panel 61 as described hereinafter. The vertical outer wall 64 also has a rear edge 68 which is of a generally outwardly curved or convex curvature which smoothly merges at its upper end with the top wall, with this curved rear edge 68 at its lower end joining to the bottom edge 66 at a rather abrupt corner 69. The end panel includes a generally endless edge flange 71 projecting horizontally inwardly from the plane of the outer wall 64, which edge flange 71 extends along substantially the entire outer periphery of the wall 64. The end panel is also provided with reinforcing ribs 72 projecting inwardly therefrom at suitable locations, which ribs project inwardly through a distance no greater than the inward projection of the edge flange 71.

Each end panel 62 and 63 is also provided with a finger grip or depression 73 formed upwardly in the edge flange 71 associated with the lower edge 66, which finger depression 73 is positioned closely adjacent the rear corner 69. This finger depression 73 at its rearward end terminates in a rather abrupt shoulder or surface so as to facilitate engagement with a finger or thumb to assist in manual swinging of the door assembly, particularly when swinging from the open position to the closed position is desired, as explained hereinafter.

Considering now the door panel 61, it is defined primarily by a front panel 74 (FIG. 8) which is longitudinally elongated throughout the length of the cabinet and is rigidly adjoined at opposite ends to the front edges of the end panels 62 and 63. This front panel 74 terminates in a lower free edge 75 which is of a generally rounded or rodlike configuration as it projects longitudinally along the length of the panel so as to define an enlarged gripping part to facilitate manual gripping if same is to be gripped so as to effect opening movement of the door. This front panel 74, when viewed in horizontal cross section as illustrated in FIG. 8, also has a nonstraight or complex curvature in that the upper section 76 of the door panel has a generally outwardly bowed or convex configuration, which configuration projects downwardly over at least about three-fourths of the overall door panel height, with this upper section 76 then smoothly merging with a lower section 77 which is of a reverse concave curvature, the latter terminating at the lower free edge 75.

The door panel 61 also has a top panel part 81 which is fixed to and projects transversely rearwardly away from the upper edge of the front panel 74. This top panel part 81 is substantially planar and extends generally longitudinally between the end panels 62 and 63, and projects rearwardly through only a small horizontal extent when the door is in the closed position. The top panel part 81 cooperates with the front edge of the cabinet top wall 32 through a cooperating anti-separation interlock 82 as illustrated in FIGS. 8 and 8B. This interlock includes a downwardly-directed cantilevered flange 83 which is fixed to and projects downwardly from the top panel part 81 adjacent the longitudinally-extending rear edge thereof. This flange 83, when the door is in the closed position, projects into an upwardly-opening channel 84 defined by a generally U-shaped channel part 85 which is fixed to and extends longitudinally along the front edge of the cabinet top wall 32. This interfitting of the flange 83 into the channel 84, when the door is in the closed position, prevents outward bowing of the door, and prevents separation of the door from the cabinet along the top wall of the door, such as due to an attempt to insert a prying tool therebetween. The flange 83 is sloped slightly rearwardly as it projects upwardly so as to facilitate the movement of the flange 83 into and out of the channel 84 during swinging of the door between the closed and open positions respectively.

To secure the door panel 61 to the end panels 62 and 63, the panel 61 has a vertically extending securing flange 61A (FIGS. 1A and 8A) projecting rearwardly adjacent each end thereof. This flange 61A projects inwardly in overlapping relation with the inside of the respective end panel 62, 63. A plurality of threaded fasteners 61B connect the flange 61A to a series of sleevelike hubs 61C provided on the end panel 62, 63.

The door assembly 24 is joined to the cabinet housing 21 through a pair of coaxially aligned pivotal connections 88 (FIGS. 8–10), which connections are provided for cooperation between each end wall 31 and the respectively adjacent end panel 62 or 63. These pivotal connections 88 define a horizontal pivot axis 89 for permitting swinging movement of the door assembly between the open and closed positions illustrated by FIGS. 1 and 3. The pivot axis 89 extends horizontally longitudinally of the cabinet and is disposed so as to extend generally centrally through the cabinet compartment, with the pivot axis 89 being located approximately vertically midway between the top and bottom walls of the cabinet, and also being located approximately horizontal midway between the rear wall of the cabinet and the front opening thereof.

The pivotal connection 88 is defined by a generally cylindrical hub 91 which is centrally fixed to and projects inwardly from the vertical wall 64 of the end panel 62 and 63. This hub 91 has a stepped blind bore 92 opening inwardly from the inner end thereof. A plurality of internally threaded fastener sleeves 93 are fixed within the hub at the inner end of the blind bore. The adjacent end wall 31 has an annular support bearing or hub 94 formed thereon, in this case integrally by being formed from the same metal plate defining the end wall, with this annular support bearing 94 being deformed axially outwardly so as to project into and be rotatably seated within the stepped blind bore 92. This annular support bearing 94, when viewed in cross section, has an axial leg part 95 which projects outwardly from the end wall 31, and this leg part 95 in turn joins to a radial inwardly projecting leg part 96, the latter defining a central opening 99 therethrough. The annular support bearing or washer 94 is retained within the bore 92 by a generally cylindrical retainer 97 which is of a stepped cylindrical construction so that the inner smaller-diameter end projects through the central opening 99 of the annular bearing. The L-shaped configuration of the support bearing 94, as defined by the legs 95 and 96, is thus rotatably retained between the hub 91 and the cylindrical retainer 97, the latter being fixed to the hub by a plurality of threaded fasteners 98 which extend therethrough and are engaged with the threaded sleeves 93. This thus provides for rotatable support of the end panel 62 or 63 on the adjacent end wall 31 so as to permit rotation of the door assembly about the longitudinally-extending pivot axis 89.

Figure 15:
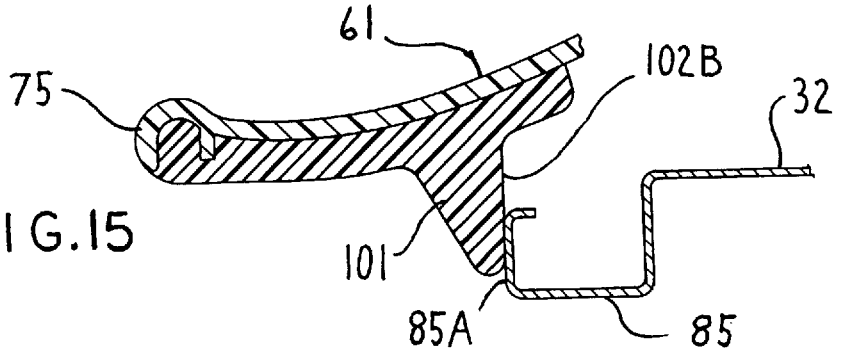
FIGS. 14 and 15 are enlarged fragmentary sectional views which show the engagement of the door stop in the door closed and open positions, respectively.
Figure 14:
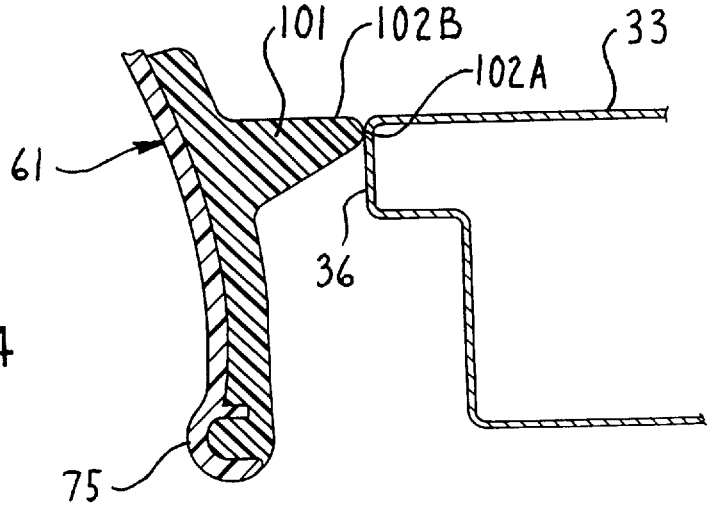

The door panel 61 also has an inwardly projecting stop 101 (FIGS. 14 and 15) fixed to the inner side thereof adjacent the lower free edge 75. This stop, which is preferably of a relatively stiff elastomeric material, projects longitudinally along the door and is disposed so that an outer rounded end surface 102A thereof abuts the front flange 36 of bottom wall 33 to define the closed position of the door (FIG. 14). This stop 101 also has a top surface 102B which, when the door is in an open position, abuts the front of the top wall 32, that is, it abuts the front flange 85A of the channel 85 (FIG. 15). This stop 101 thus functions to define the position limits for the opening or closing movement of the door assembly, which position limits are designed to permit the door to swingably move through an angle of about 90° when being moved between the open and closed positions.

The door assembly 24 also includes an adjustable counterweight structure 104 (FIGS. 8–10) preferably associated with and evenly distributed on each of the end panels 62 and 63 so as to effectively counterbalance the eccentric weight created by the door panel 61 about the pivot axis 89. This counterweight structure 104, in the variation of FIGS. 8–10, includes a set of one or more thin counterweights 105 which are stationarily housed in the rear portion of each of the end panels 62 and 63. Each counterweight 105 is formed substantially as a thin metal plate (for example having a thickness of about 0.060 inch in one embodiment) having a generally half circular configuration so as to be positionable in the rearward part of the end panel 62, 63 in generally uniformly disposed relation about the axis 89 so that the center of gravity (i.e., c.g.) of the counterweight 105 is positioned rearwardly of a vertical plane passing through this axis 89 when the door is in the closed position.

Figure 10:
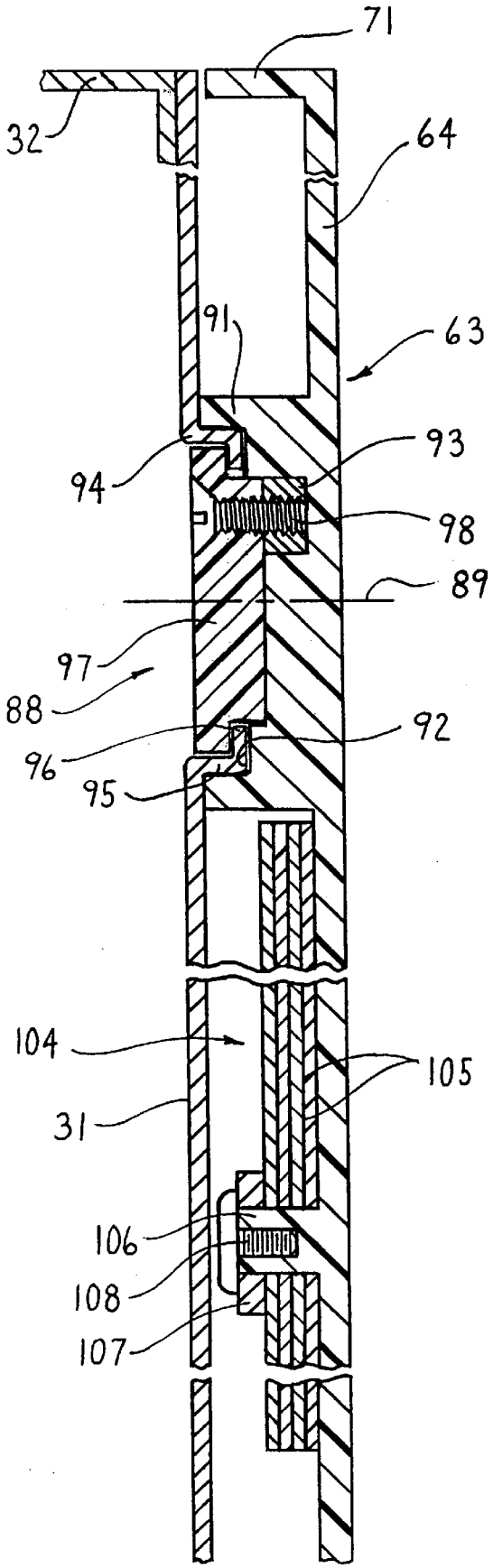
FIG. 10 is an enlarged fragmentary sectional view taken generally along line 10—10 in FIG. 8.

The counterweight structure 104 is formed by one or more generally identical counterweights 105, with these counterweights being disposed in superimposed relationship to one another, four such counterweights being illustrated in FIG. 10, with the number of such counterweights 105 being selected in accordance with the longitudinal length of the cabinet. For example, if the cabinet is of short length such as approximately 24 inches, then two identical counterweights 105 may be used in each end panel 62, 63. If the cabinet is of greater length for example 30 or 36 inches, then respectively three or four superimposed identical counterweights 105 may be used in each end panel. Similarly, if the cabinet is of greater length for example 48 or 60 inches, then respectively six or eight identical counterweights 105 may be used in superimposed relation within each end panel. In this manner, a plurality (i.e. a set) of identical counterweights 105 can be provided for each end panel, and the overall counterweight structure is easily adjusted and built up to the desired magnitude in accordance with the longitudinal length of the cabinet, which length corresponds to the length of the door panel 24 and hence the unbalanced weight thereof.

As illustrated by FIGS. 9 and 10, the counterweights 105 are mounted within the end panel 62, 63 due to the latter having a pair of cantilevered support pins or hubs 106 projecting inwardly from the wall 64, which pins 106 project through suitable openings formed in the counterweights. In the illustrated embodiment the counterweight structure includes less than the maximum number of counterweights 105, and accordingly in such instance one or more spacers 107 are also provided in surrounding relationship to the support pins 106. A suitable fastener 108 threads into each of the support pins 106, and the enlarged head of the fastener cooperates with the spacer or with the counterweights to captivate them in position. It will be apparent that if the maximum number of counterweights are utilized, then no spacer is required. Alternately, the end panels can be provided with shorter hubs 106, and screws 108 of different lengths used in accordance with the thickness of the stacked counterweights.

Figure 16:
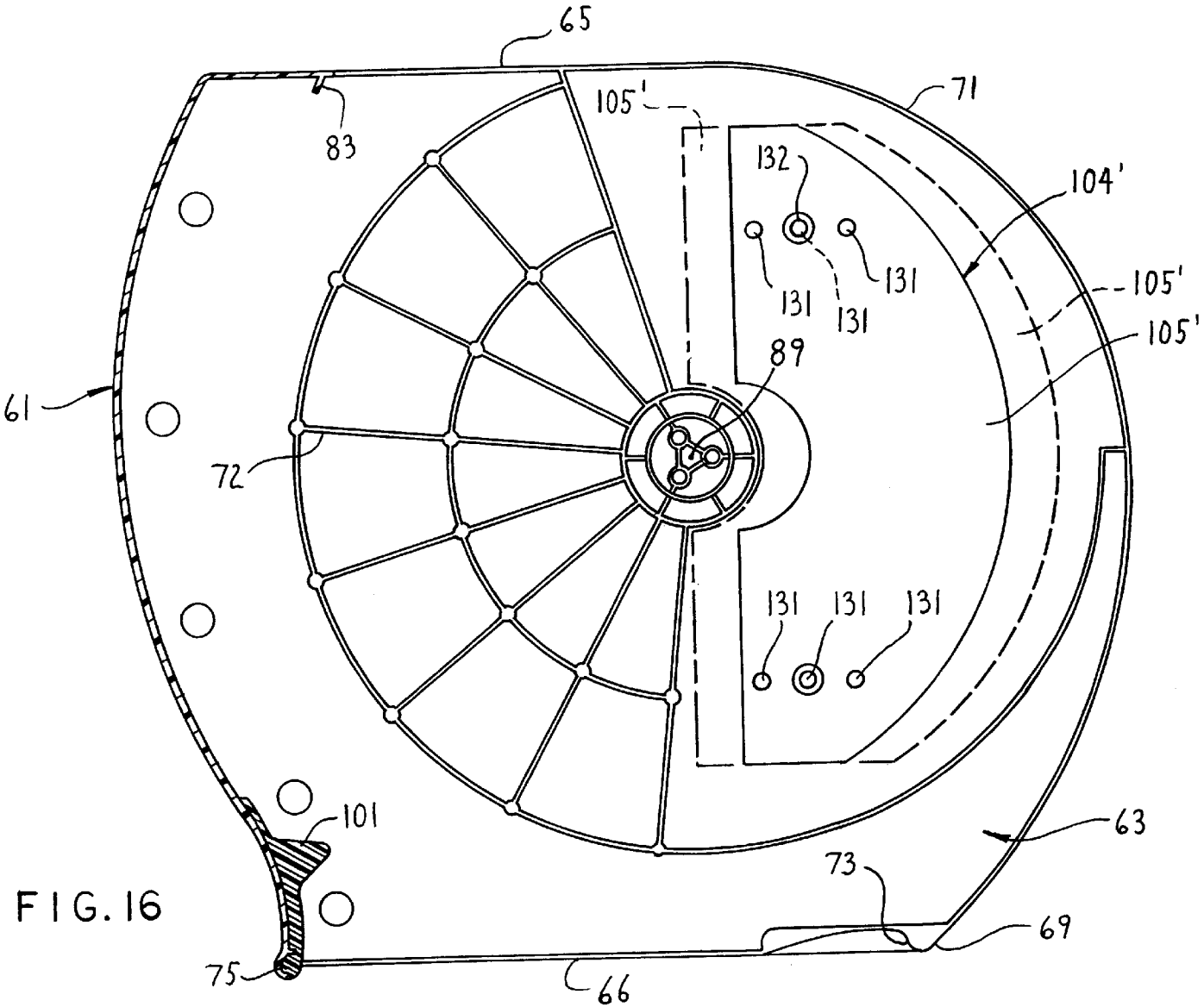
FIG. 16 is an elevational view of the inside of the door end panel and showing a modification of the counterweight arrangement.

FIG. 16 illustrates a variation of an adjustable counterweight structure 104 which mounts on the end panels 62, 63 so as to permit counterbalancing of the swingable door 61 in accordance with cabinet (and hence door) length. Each end panel mounts a counterweight 105' thereon, preferably a single counterweight, by a position-adjusting mounting arrangement which includes a pair of mounting hubs (such as hubs 106 of FIG. 9) each positioned in one of a set of openings 131, which set includes three openings in the illustrated embodiment. A fastener such as a screw 132 secures the counterweight 105' to the end panel. The spacing between the openings of the set 131 permits the counterweight 105' to be mounted in several different positions which are spaced different distances from the axis 89 to vary the counterbalance moment in proportion to the cabinet door length. By using the innermost openings the counterweight 105' is positioned outermost as shown by dotted lines such as to balance a long door 61 such as a 48-inch door. By using the outermost openings the counterweight 105' is positioned closest to the axis 89 as shown by dash-dot lines so as to counterbalance a short door such as a 24-inch door. And by using the middle openings the counterweight 105' is mounted in an intermediate position as shown in solid lines so as to balance an intermediate length door such as a 36-inch door.

The door assembly 24 (i.e., the door panel 61 and the end panels 62, 63) when provided with the counterweight structure 104 thereon (i.e., the counterbalanced door assembly), has a center of gravity G (FIG. 8) which is preferably disposed on an axis which is parallel to but spaced slightly forwardly and upwardly with respect to the rotational axis 89 when the door assembly is in the closed position. This center of gravity G is disposed so as to be overcenter (i.e. forwardly) relative to the vertical plane containing the axis 89, and thus the small unbalanced weight of the door panel 24 (with the counterweight structure 104 thereon) biases the door assembly into the closed position illustrated by FIG. 8. Swinging of the counterbalanced door assembly into the open overhead position through substantially a 90° angle, however, results in the center of gravity being moved rearwardly onto the other side of the vertical plane containing the axis 89, the center of gravity as designated G' in FIG. 8 thus being spaced rearwardly and upwardly with respect to the axis 89 to thus bias the door into the open position wherein the stop 101 engages the top front flange 85A. In this manner, the small unbalanced weight of the counterbalanced door assembly 24 effectively passes over center when moving between the open and closed positions G' and G, and thus always urges the door assembly either into the open or the closed position. The counterbalance structure 104 is selected, however, so that the overall unbalanced weight of the counterbalanced door assembly and specifically the center of gravity G (or G') thereof is always disposed slightly spaced from but closely adjacent the rotational axis 89. For example, this center of gravity G (or G') is normally radially spaced by no more than about one inch from the rotational axis 89, and more preferably the center of gravity G (or G') is radially spaced from the rotational axis 89 by a distance less than about one-half inch. With such arrangement, the unbalanced force urging the counterbalanced door assembly into the closed position is such that the door assembly can be swingably moved upwardly away from the closed position by an extremely small manually-applied lifting force, such as a lifting force in the range of one to two pounds as applied at the edge 75. Similarly, a very small manual force of similar or smaller magnitude, as applied at the depression 73, is suitable for moving the door away from the open position when closing of the door is desired.

To permit fine tuning or adjustment in the position of the center of gravity G, the counterweights 105 can be slightly angularly displaced about the axis 89 relative to the end panel 63, 64.

Figure 2:
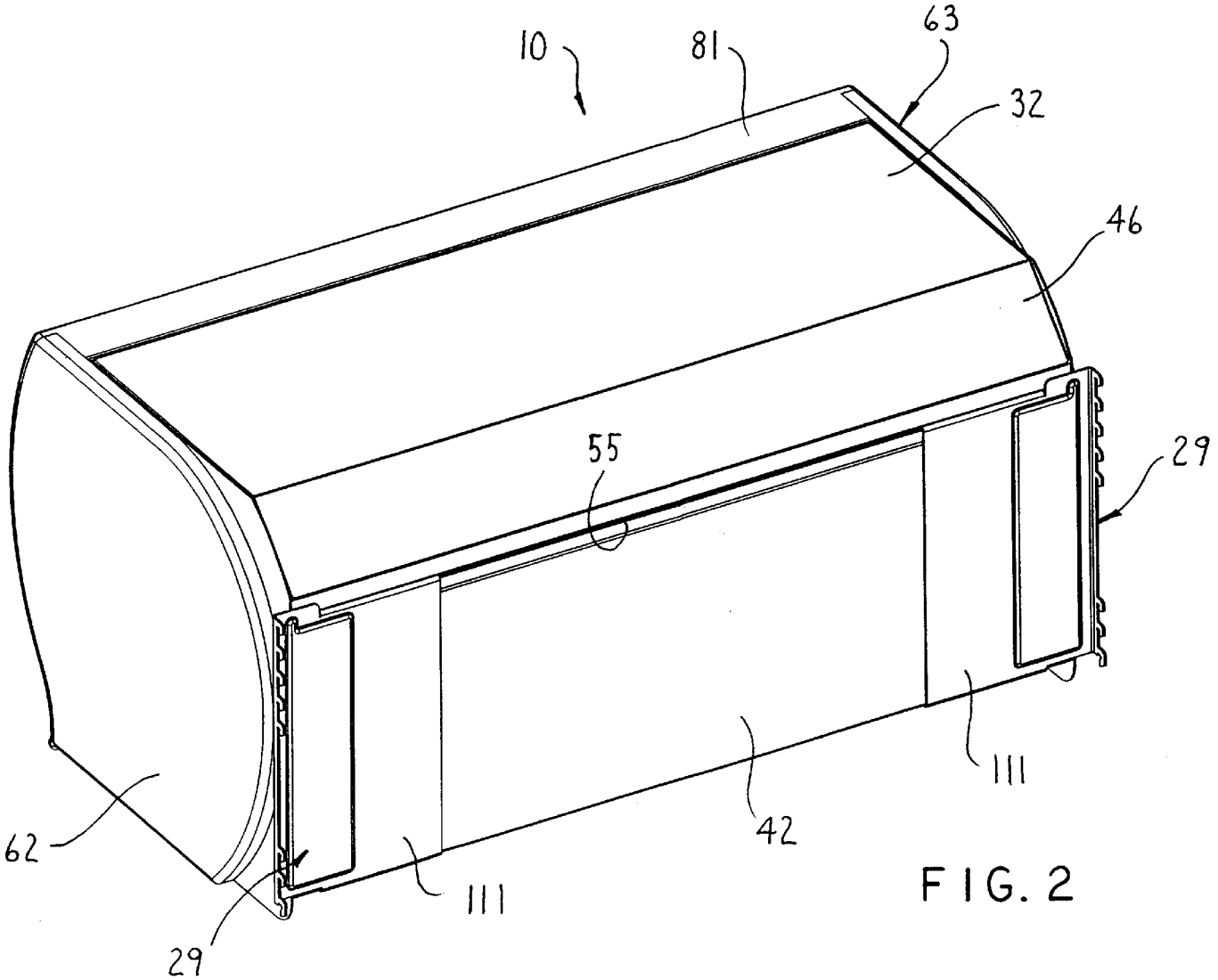
FIG. 2 is a rear perspective view of the cabinet shown in FIG. 1.
Figure 12:
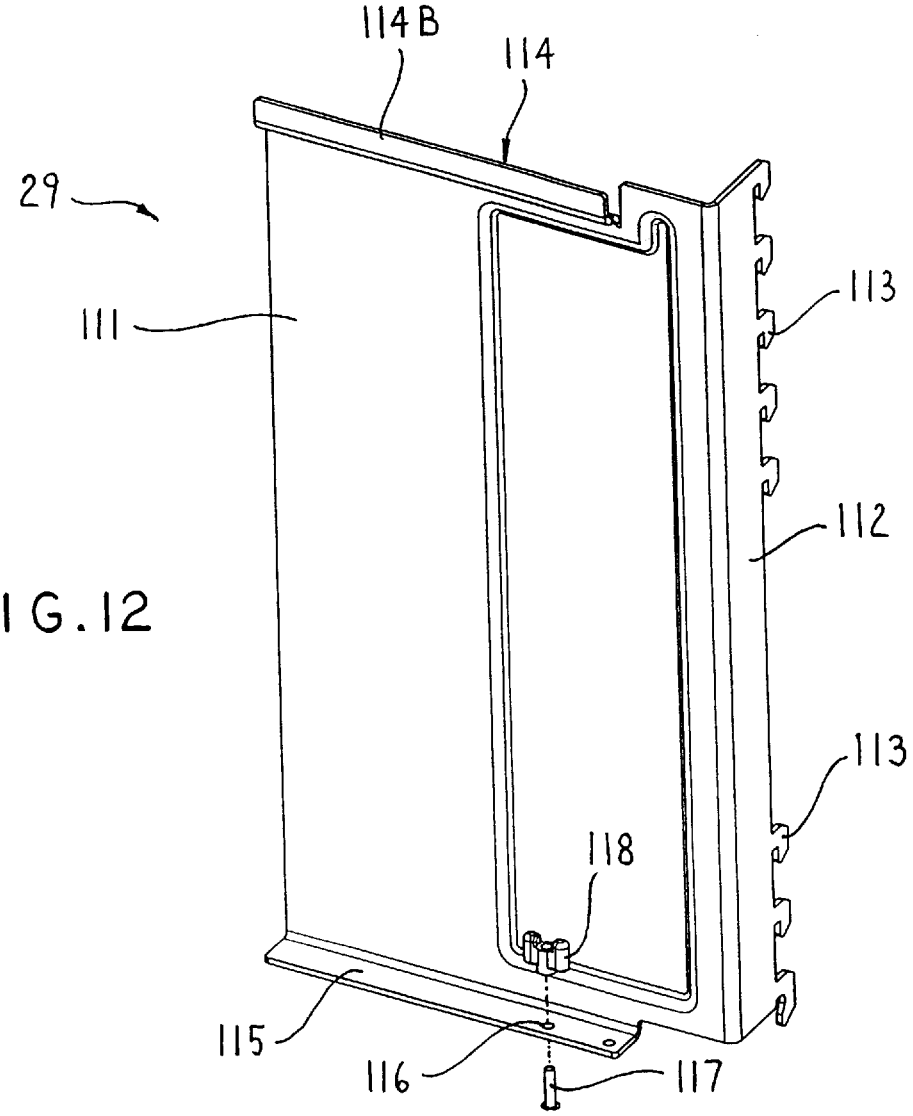
FIG. 12 is a perspective view showing a hook-type bracket which attaches to the rear of the cabinet to permit attachment to a slotted rail.

To effect mounting of the cabinet 10 on an upright wall such as the wall 11 of FIG. 1, the cabinet can be connected to the wall through a pair of mounting brackets 29 which are disposed for cooperation adjacent opposite ends of the cabinet. Each mounting bracket, as illustrated in FIGS. 2, 8 and 12, includes a generally vertically enlarged mounting plate 111 which overlies and extends vertically adjacent the rear wall 42 of the cabinet, and this mounting plate has a rearwardly projecting vertically-extending flange 112 provided with a plurality of vertically spaced L-shaped hooks 113 projecting outwardly therefrom. This flange 112 and the L-shaped hooks 113 thereon are adapted for insertion into and engagement with a vertically slotted rail 121 (FIG. 1) associated with the wall, the latter being conventional and well known. The mounting plate 111 also has a generally L-shaped hook 114 (FIG. 8C) projecting inwardly therefrom, which hook 114 projects inwardly and upwardly for engagement longitudinally along the guide channel 55 so as to permit securement of the cabinet housing to the mounting bracket. The L-shaped hook 114 has a forwardly projecting base flange 114A which abuts the lower edge of rear flange 47 so as to support the cabinet weight, and base flange 114A terminates in an upwardly cantilevered retaining flange 114B which projects upwardly and overlaps the front face of the rear flange 47.

The plate 111 of mounting bracket 29 also has an inwardly (i.e. forwardly) turned bottom flange 115 (FIGS. 8 and 12) which is positioned directly below and in overlapping relation to the horizontal part of the rear flange 44 of the bottom shelf. This bottom flange has a plurality of openings 116 therethrough, one of which receives a fastener 117 such as a rivet which extends upwardly from the flange 115 and mounts a rotatable wing-type securing fastener 118 thereon. The flange 115 is positionable below rear wall flange 44 so that fastener 118 can be inserted upwardly through one of the elongated slots 44A. Fastener 118 is then rotated 90° to extend transversely across the slot 44A to thus fixedly secure the bottom of bracket 29 to the rear of the cabinet housing.

A pair of longitudinally spaced mounting brackets 29 can thus be positioned and secured to the rear wall of the cabinet housing at numerous closely adjacent positions longitudinally along the length thereof, but preferably in the vicinity of the opposite ends of the cabinet. The variable positioning of the mounting brackets on the cabinet enables the cabinet to be mounted on a series of upright space-divider panels, even though the length of the cabinet may not correspond to the panel length or the spacing between the slotted rails associated with the panels. This thus enables either longer or shorter cabinets to be mounted on either longer or shorter panels, this mounting often being referred to as off-module mounting.

Figure 13:
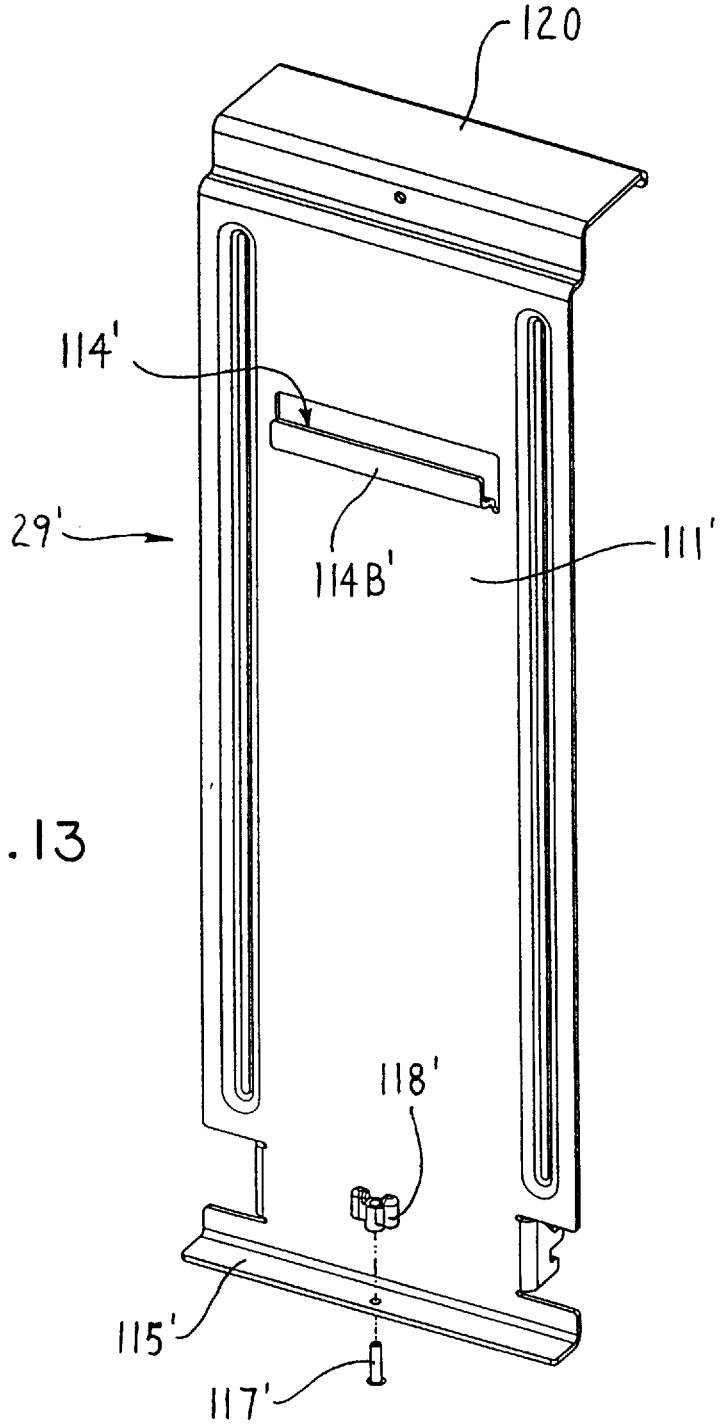
FIG. 13 is a perspective view of an alternate form of a mounting bracket for securing the cabinet to an upright wall or other suitable support.

While the mounting bracket 29 illustrates one type of mounting for the cabinet 10, numerous other types of mountings are possible. For example, as illustrated in FIG. 13, a variation of a mounting bracket 29' is not provided with the flange 112 and hooks 113, but rather is provided with a mounting hook 120 which is fixed to and extends longitudinally along the upper edge of plate 111'. This hook 120 is channel-shaped and projects rearwardly from the plate 111 and open downwardly to permit it to be supportively engaged on a suitable support element. Such hooks 120 can be engaged over suitable support rails or panels so as to permit mounting of the storage cabinet thereon at any location longitudinally therealong.

It will be appreciated that the cabinet of the present invention is equally suitable for cooperation with numerous other types of mounting brackets, and further description thereof is believed unnecessary.

Figure 7:
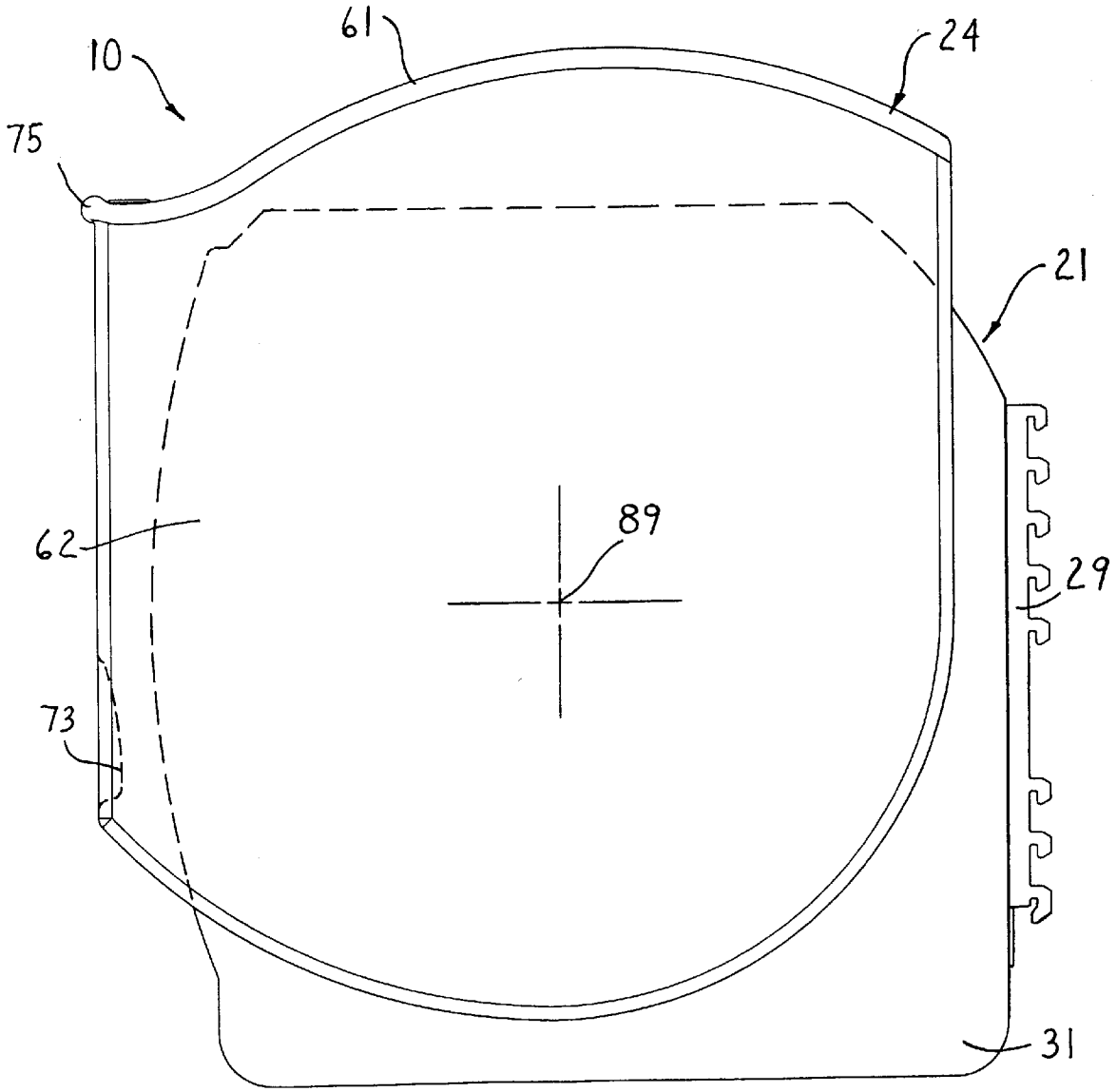
FIG. 7 is a right end elevational view similar to FIG. 6 but showing the door in an open overhead position.

When the cabinet is mounted in overhead relationship relative to a worksurface, such as diagrammatically illustrated in FIG. 17, the cabinet is positioned and designed so as to enable a person seated adjacent the front edge 14 of the worksurface to readily open and close the door assembly 24 while remaining in a seated position. For example, when the cabinet is in the closed position as illustrated by FIG. 8 and as illustrated by solid lines in FIG. 17, the person can readily reach and grippingly engage either the lower edge 75 of the door or the bottom front corner of the end panel 62 or 63, and thus swing the door assembly upwardly into the overhead storage position, which swinging movement is easily accomplished due to the counterweighing of the door. Conversely, when the door is in the open overhead position illustrated by FIG. 7 and as shown by dotted lines in FIG. 17, the rear corners of the end panels are now disposed adjacent the front lower corners of the cabinet, and the finger depressions 73 are thus readily accessible. The person can thus readily engage the finger depressions while remaining in a seated position, and exert a pushing force which readily effects swinging movement of the door back into its closed position. The opening and closing of the door are thus easy to accomplish in a safe and convenient manner due not only to improved user access to the door, but also due to the adjustable counterbalancing of the door in dependence on door weight (i.e., door length).

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. In a storage cabinet having a housing defined by generally horizontally-extending top and bottom walls rigidly joined together by generally parallel vertically-extending side walls, the housing defining therein an interior storage compartment and having an access opening in a front side thereof for access to said storage compartment, and a door assembly including a door panel positionable adjacent the front side of the housing when the door assembly is in a closed position for closing off said access opening, said door assembly being vertically swingably supported on said housing for swinging movement between said closed position and an open position wherein said door panel is positioned generally over said top wall to permit access to said storage compartment through said access opening, the improvement comprising:

said door assembly being of a generally U-shaped configuration and including right and left end panels which are fixed to opposite ends of said door panel and which project generally perpendicularly therefrom in cantilevered relationship relative thereto, said right and left end panels being disposed in substantially parallel relation;

each of said end panels being positioned exteriorly but in closely adjacent and overlying relationship to a respective one of said side walls, whereby said side walls of said housing are positioned longitudinally between said right and left end panels;

aligned horizontal hinge means connected between each of said end panels and a respectively adjacent side wall for vertically swingably supporting said door assembly for solely vertical swinging movement between said open and closed positions, said hinge means defining a horizontal hinge axis which extends longitudinally of said cabinet and which substantially centrally intersects said side walls and said end panels; and counterweight means attached to each of said end panels for at least partially counterbalancing the weight of the door panel acting about said hinge axis, said counterweight means including at least one counterweight member removably attached to the respective end panel and positioned so that the center of gravity of said counterweight member is spaced radially from said hinge axis in an opposite direction from said door panel.

2. A storage cabinet according to claim 1, wherein the counterweight means includes a set of substantially identical said counterweight members with one or more said counterweight members being removably attached to each of said end panels in accordance with the longitudinal length of said cabinet.

3. A storage cabinet according to claim 1, including interlock means extending longitudinally along and coacting between an upper edge of said door panel and a front edge of said top wall when said door assembly is in said closed position for preventing outward bowing of said door panel.

4. A storage cabinet according to claim 3, wherein said upper edge of said door panel and a lower edge of said door panel are in substantial vertical alignment with one another in said closed position of said door assembly, and said interlock means includes a flange fixed to and extending longitudinally along said upper edge of said door panel, said flange being cantilevered downwardly, and a channel part fixed to and extending longitudinally along said front edge of said top wall, said channel part projecting downwardly from said top wall and defining therein an upwardly-facing channel which projects downwardly from said top wall into which said flange projects when said door assembly is in said closed position, said flange moving out of said channel when said door assembly is moved to said open position.

5. A storage cabinet according to claim 1, wherein said counterweight means is adjustable to provide a counterbalance moment which is selected substantially in proportion to the moment created by the weight of the door.

6. A storage cabinet according to claim 5, wherein said counterweight member is adjustably positioned on the respective end panel relative to the hinge axis to provide the counterbalance moment substantially in proportion to the moment created by the weight of the door.

7. A storage cabinet according to claim 6, wherein said counterweight member is mounted on the respective end panel at a selected one of several discrete positions wherein the center of gravity of the counterweight member is spaced different radial distances from said hinge axis.

8. A storage cabinet according to claim 5, wherein said counterweight means includes a plurality of discrete said counterweight members, a selected number of said counterweight members being mounted on each of said end panels generally in proportion to the longitudinal length of the door panel.

9. A storage cabinet according to claim 1, wherein said door assembly, with said counterweight means attached thereto, has a center of gravity which is positioned closely adjacent but spaced slightly forwardly and upwardly from said hinge axis so that said center of gravity moves upwardly over said hinge axis into a position wherein it is spaced rearwardly and upwardly relative to said hinge axis when said door assembly is in said open position, whereby the weight of the door assembly with the counterweight means attached thereto always exerts a small biasing force urging the door assembly into the respective open or closed position.

10. In a storage cabinet having a housing defined by generally horizontally-extending top and bottom walls rigidly joined together by generally parallel vertically-extending side walls, the housing defining therein an interior storage compartment and having an access opening in a front side thereof for access to said storage compartment, and a door assembly including a door panel positionable adjacent the front side of the housing when the door assembly is in a closed position for closing off said access opening, said door assembly being vertically swingably supported on said housing for swinging movement between said closed position and an open position wherein said door panel is positioned generally over said top wall to permit access to said storage compartment through said access opening, the improvement comprising:

said door assembly being of a generally U-shaped configuration and including right and left end panels which are fixed to opposite ends of said door panel and which project generally perpendicularly therefrom in cantilevered relationship relative thereto, said right and left end panels being disposed in substantially parallel relation;

each of said end panels being positioned exteriorly but in closely adjacent and overlying relationship to a respective one of said side walls, whereby said side walls of said housing are positioned longitudinally between said right and left end panels;

aligned horizontal hinge means connected between each of said end panels and a respectively adjacent side wall for vertically swingably supporting said door assembly for solely vertical swinging movement between said open and closed positions, said hinge means defining a horizontal hinge axis which extends longitudinally of said cabinet and which substantially centrally intersects said side walls;

counterweight means attached to each of said end panels for at least partially counterbalancing the weight of the door panel acting about said hinge axis, said counterweight means including at least one counterweight member removably attached to the respective end panel and positioned so that the center of gravity of said counterweight member is spaced radially from said hinge axis in an opposite direction from said door panel; and each of said end panels and the respectively adjacent side wall cooperate to define therebetween a shallow cavity within which said counterweight member is disposed.

11. A storage cabinet according to claim 10, wherein a said shallow cavity is defined within each of said end panels and is substantially closed off by the close proximity and overlying relationship thereof to the respective side wall.

12. A storage cabinet according to claim 10, wherein said counterweight means includes a plurality of discrete and thin said counterweight members, a selected number of said counterweight members being mounted on each of said end panels and within said shallow cavity generally in proportion to the longitudinal length of said door panel.

13. A storage cabinet according to claim 12, wherein at least two of said counterweight members are disposed within said cavity in generally superimposed relationship to one another.

14. In a storage cabinet having a housing defined by generally horizontally-extending top and bottom walls rigidly joined together by generally parallel vertically-extending side walls, the housing defining therein an interior storage compartment and having an access opening in a front side thereof for access to said storage compartment, and a door assembly including a door panel positionable adjacent the front side of the housing when the door assembly is in a closed position for closing off said access opening, said door assembly being vertically swingably supported on said housing for swinging movement between said closed position and an open position wherein said door panel is positioned generally over said top wall to permit access to said storage compartment through said access opening, the improvement comprising:

said door assembly being of a generally U-shaped configuration and including right and left end panels which are fixed to opposite ends of said door panel and which project generally perpendicularly therefrom in cantilevered relationship relative thereto, said right and left end panels being disposed in substantially parallel relation;

each of said end panels being positioned exteriorly but in closely adjacent and overlying relationship to a respective one of said side walls, whereby said side walls of said housing are positioned longitudinally between said right and left end panels;

aligned horizontal hinge means connected between each of said end panels and a respectively adjacent side wall for vertically swingably supporting said door assembly for solely vertical swinging movement between said open and closed positions, said hinge means defining a horizontal hinge axis which extends longitudinally of said cabinet and which substantially centrally intersects said side walls;

counterweight means attached to each of said end panels for at least partially counterbalancing the weight of the door panel acting about said hinge axis, said counterweight means including at least one counterweight member removably attached to the respective end panel and positioned so that the center of gravity of said counterweight member is spaced radially from said hinge axis in an opposite direction from said door panel;

said counterweight means including a set of substantially identical said counterweight members with one or more said counterweight members being removably attached to each of said end panels in accordance with the longitudinal length of said cabinet; and each of said end panels define a shallow cavity which opens inwardly thereof, said cavity being disposed in directly opposed and adjacent relationship to the respectively adjacent side wall, and at least two said counterweight members being fixedly but removably disposed within said cavity in generally superimposed relationship to one another.

15. In a storage cabinet having a housing defined by generally horizontally-extending top and bottom walls rigidly joined together by generally parallel vertically-extending side walls, the housing defining therein an interior storage compartment and having an access opening in a front side thereof for access to said storage compartment, and a door assembly including a door panel positionable adjacent the front side of the housing when the door assembly is in a closed position for closing off said access opening, said door assembly being vertically swingably supported on said housing for swinging movement between said closed position and an open position wherein said door panel is positioned generally over said top wall to permit access to said storage compartment through said access opening, the improvement comprising:

said door assembly being of a generally U-shaped configuration and including right and left end panels which are fixed to opposite ends of said door panel and which project generally perpendicularly therefrom in cantilevered relationship relative thereto, said right and left end panels being disposed in substantially parallel relation;

each of said end panels being positioned exteriorly but in closely adjacent and overlying relationship to a respective one of said side walls, whereby said side walls of said housing are positioned longitudinally between said right and left end panels;

aligned horizontal hinge means connected between each of said end panels and a respectively adjacent side wall for vertically swingably supporting said door assembly for solely vertical swinging movement between said open and closed positions, said hinge means defining a horizontal hinge axis which extends longitudinally of said cabinet and which substantially centrally intersects said side walls;

counterweight means attached to each of said end panels for at least partially counterbalancing the weight of the door panel acting about said hinge axis, said counterweight means including at least one counterweight member removably attached to the respective end panel and positioned so that the center of gravity of said counterweight member is spaced radially from said hinge axis in an opposite direction from said door panel; and each of said end panels having an outer periphery defined by upper and lower edges positioned closely adjacent the respective top and bottom walls of the housing when the door assembly is in the closed position, said outer periphery also including a generally curved convex rear edge which extends between the upper and lower edges, said rear edge being disposed at a position adjacent a rear side of said housing when said door assembly is in said closed position so that each of said end panels substantially exteriorly covers the respective side wall and defines the visible exterior end of the cabinet.

16. A storage cabinet according to claim 15, wherein the upper and lower edges of each of said end panels are generally horizontal and parallel when said door assembly is in said closed position, and a gripping part is defined on the peripheral edge of each of said end panels at said lower edge adjacent a rearward end thereof, said gripping part being positioned adjacent a lower front corner of said cabinet when said door assembly is in said open position to facilitate manual closing of the door assembly.

17. A storage cabinet according to claim 15, wherein said upper, lower and rear edges of each of said end panels cooperate to define a shallow cavity facing the respective side wall within which said counterweight member is disposed.

18. In a storage cabinet having a housing defined by generally horizontally-extending top and bottom walls rigidly joined together by generally parallel vertically-extending side walls, the housing defining therein an interior storage compartment and having an access opening in a front side thereof for access to said storage compartment, and a door assembly including a door panel positionable adjacent the front side of the housing when the door assembly is in a closed position for closing off said access opening, said door assembly being vertically swingably supported on said housing for swinging movement between said closed position and an open position wherein said door panel is positioned generally over said top wall to permit access to said storage compartment through said access opening, the improvement comprising:

said door assembly being of a generally U-shaped configuration and including right and left end panels which are fixed to opposite ends of said door panel and which project generally perpendicularly therefrom in cantilevered relationship relative thereto, said right and left end panels being disposed in substantially vertically parallel relation, each of said end panels being positioned in closely adjacent and overlying relationship to a respective one of said side walls;

aligned horizontal hinge means connected between each of said end panels and a respectively adjacent side wall for movably supporting said door assembly for solely vertical swinging movement between said open and closed positions, said hinge means defining a horizontal hinge axis which extends longitudinally of said cabinet and which substantially centrally intersects said side walls;

said door panel having longitudinally extending upper and lower edges in substantial vertical alignment with one another in said closed position of said door assembly;

interlock means extending longitudinally along and coacting between said upper edge of said door panel and a front edge of said top wall when said door assembly is in said closed position for preventing outward separation of said door panel away from said top wall; and said interlock means including a flange fixed to and extending longitudinally along said upper edge of said door panel, said flange being cantilevered downwardly, and a channel part fixed to and extending longitudinally along said front edge of said top wall, said channel part projecting downwardly from said top wall and defining an upwardly-opening channel which projects downwardly from said top wall into which said flange projects when said door assembly is in said closed position, said flange moving out of said channel when said door assembly is moved to said open position.

19. A storage cabinet according to claim 18, wherein each of said end panels are positioned to exteriorly overlie and substantially cover the entire respectively adjacent side wall.

20. In a storage cabinet having a housing defined by generally horizontally-extending top and bottom walls rigidly joined together by generally parallel vertically-extending side walls, the housing defining therein an interior storage compartment and having an access opening in a front side thereof for access to said storage compartment, and a door assembly including a door panel positionable adjacent the front side of the housing when the door assembly is in a closed position for closing off said access opening, said door assembly being vertically swingably supported on said housing for swinging movement between said closed position and an open position wherein said door panel is positioned generally over said top wall to permit access to said storage compartment through said access opening, the improvement comprising:

said door assembly being of a generally U-shaped configuration and including right and left end panels which are fixed to opposite ends of said door panel and which project generally perpendicularly therefrom in cantilevered relationship relative thereto, said right and left end panels being disposed in substantially vertically parallel relation;

each of said end panels being positioned exteriorly but in closely adjacent and overlying relationship to a respective one of said side walls, whereby said side walls of said housing are positioned longitudinally between said right and left end panels;

aligned horizontal hinge means connected between each of said end panels and a respectively adjacent side wall for movably supporting said door assembly for solely vertical swinging movement between said open and closed positions, said hinge means defining a horizontal hinge axis which extends longitudinally of said cabinet and which substantially centrally intersects said side walls; and each of said end panels having an outer periphery including upper and lower edges positioned closely adjacent the respective top and bottom walls of the housing when the door assembly is in the closed position, said outer periphery also including a generally curved convex rear edge which extends between the upper and lower edges, said rear edge being disposed at a position adjacent a rear side of said housing when said door assembly is in said closed position so that each of said end panels substantially exteriorly covers the respective side wall and defines the visible exterior end of the cabinet.

21. A storage cabinet according to claim 20, wherein a gripping part is defined on the peripheral edge of each of said end panels at said lower edge adjacent a rearward end thereof, whereby said gripping part is positioned adjacent a lower front corner of said cabinet when said door assembly is in said open position to facilitate manual closing of the door assembly.

22. A storage cabinet according to claim 21, wherein each of said end panels has a peripheral rim part extending therearound and positioned closely adjacent the respective side wall, said rim part including therein a depression functioning as said gripping part for engagement by a user, said depression being defined in said rim part and positioned adjacent a lower rear corner of said cabinet when said door assembly is in said closed position.

23. A storage cabinet according to claim 21, including interlock means extending longitudinally along and coacting between an upper edge of said door panel and a front edge of said top wall when said door assembly is in said closed position for preventing outward bowing of said door panel.

24. A storage cabinet according to claim 20, including a longitudinally elongated stop fixed to an inner side of said door adjacent a free edge thereof and projecting inwardly therefrom, said stop contacting a front edge of said bottom wall when said door is in said closed position, said stop contacting a front edge of said top wall when said door is in said open position.

25. A storage cabinet according to claim 20, including counterweight means attached to each of said end panels for at least partially counterbalancing the weight of the door panel acting about said hinge axis, said counterweight means including at least one counterweight member removably attached to the respective end panel and positioned so that the center of gravity of said counterweight member is spaced radially from said hinge axis in an opposite direction from said door panel.

26. A storage cabinet according to claim 25, wherein each of said end panels and the respectively adjacent side wall cooperate to define therebetween a shallow cavity within which said counterweight member is disposed.

27. A storage cabinet according to claim 26, wherein said shallow cavity is defined within each of said end panels and is substantially closed off by the close proximity and overlying relationship thereof to the respective side wall.

28. A storage cabinet according to claim 25, wherein said counterweight member includes a plurality of identical discrete and thin plate-like elements, a selected number of said elements being removably mounted on each of said end panels generally in proportion to the longitudinal length of the door panel.

29. A storage cabinet according to claim 28, wherein each of said end panels define a shallow cavity which opens inwardly thereof, said cavity being disposed in directly opposed and adjacent relationship to the respectively adjacent side wall, and at least two said elements being fixedly but removably disposed within said cavity in generally superimposed relationship to one another.

30. In a storage cabinet having a housing defined by generally horizontally-extending top and bottom walls rigidly joined together by generally parallel vertically-extending side walls, the housing defining therein an interior storage compartment and having an access opening in a front side thereof for access to said storage compartment, and a door assembly including a door panel positionable adjacent the front side of the housing when the door assembly is in a closed position for closing off said access opening, said door assembly being vertically swingably supported on said housing for swinging movement between said closed position and an open position wherein said door panel is positioned generally over said top wall to permit access to said storage compartment through said access opening, the improvement comprising:

said door assembly being of a generally U-shaped configuration and including right and left end panels which are fixed to opposite ends of said door panel and which project generally perpendicularly therefrom in cantilevered relationship relative thereto, said right and left end panels being disposed in substantially parallel relation;

each of said end panels being positioned exteriorly but in closely adjacent and overlying relationship to a respective one of said side walls, whereby said side walls of said housing are positioned longitudinally between said right and left end panels;

aligned horizontal hinge means connected between each of said end panels and a respectively adjacent side wall for vertically swingably supporting said door assembly for solely vertical swinging movement between said open and closed positions, said hinge means defining a horizontal hinge axis which extends longitudinally of said cabinet and which substantially centrally intersects said side walls; and adjustable counterweight means for counterbalancing the weight of the door panel acting about the hinge axis, said counterweight means comprising a plurality of identical discrete and thin plate-like elements attached to each of said end panels, said elements being removably attached to the respective end panel in a generally superimposed relationship to one another and being positioned so that the center of gravity of said elements is spaced radially from said hinge axis in an opposite direction from said door panel, a selected number of said elements being mounted on each of said end panels generally in proportion to the longitudinal length of said door panel.

* * * * *